US010882325B2

(12) United States Patent
Eto et al.

(10) Patent No.: US 10,882,325 B2
(45) Date of Patent: Jan. 5, 2021

(54) LIQUID SUPPLY UNIT AND LIQUID INJECTION DEVICE

(71) Applicant: KYOCERA Document Solutions Inc., Osaka (JP)

(72) Inventors: Daisuke Eto, Osaka (JP); Masaaki Maruta, Osaka (JP); Tomoya Hotani, Osaka (JP); Yuki Tamura, Osaka (JP); Ryo Matsuyama, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/363,084

(22) Filed: Mar. 25, 2019

(65) Prior Publication Data

US 2019/0291454 A1 Sep. 26, 2019

(30) Foreign Application Priority Data

Mar. 26, 2018 (JP) ..... 2018-057663
Mar. 26, 2018 (JP) ..... 2018-057668

(51) Int. Cl.
*B41J 2/17* (2006.01)
*B41J 2/175* (2006.01)
*B41J 2/055* (2006.01)

(52) U.S. Cl.
CPC ..... *B41J 2/17596* (2013.01); *B41J 2/055* (2013.01); *B41J 2/175* (2013.01); *B41J 2/17523* (2013.01); *B41J 2/17556* (2013.01)

(58) Field of Classification Search
None
See application file for complete search history.

(56) References Cited

U.S. PATENT DOCUMENTS 8,480,216 B2 7/2013 Matsumoto et al.
9,623,669 B2 4/2017 Kato et al.
(Continued)

FOREIGN PATENT DOCUMENTS

CN 102218924 10/2011
EP 1 839 878 10/2007
(Continued)

OTHER PUBLICATIONS

Extended European Search Report dated Aug. 6, 2019.
Chinese Office Action dated Apr. 29, 2020.

*Primary Examiner* — Erica S Lin
(74) *Attorney, Agent, or Firm* — Gerald E. Hespos; Michael J. Porco; Matthew T. Hespos

(57) ABSTRACT

A liquid supply unit includes a first chamber, a second chamber, an opening/closing member, a biasing member, a pressing member and a flexible film member. The first chamber communicates with a liquid storage container, and the second chamber communicates with a liquid injection head. The opening/closing member changes a posture between a closing posture for closing a communication opening and an opening posture for opening it. The biasing member biases the opening/closing member in a direction toward the closing posture. The pressing member presses the opening/closing member in a direction toward the opening posture. The flexible film member is displaced based on a negative pressure generated in the second chamber. When a pressure receiving portion of the pressing member receives the displacement force from the flexible film member, the pressing member rotates about a pivot point and presses the opening/closing member against a biasing force of the biasing member.

9 Claims, 27 Drawing Sheets

(56) References Cited

U.S. PATENT DOCUMENTS

| | | | | |
|---|---|---|---|---|
| 2004/0051766 | A1 | 3/2004 | Miyazawa et al. | |
| 2004/0257413 | A1 | 12/2004 | Anderson, Jr. et al. | |
| 2005/0073559 | A1 | 4/2005 | Aruga et al. | |
| 2005/0231571 | A1 | 10/2005 | Miyazawa et al. | |
| 2008/0316287 | A1 | 12/2008 | Miyazawa et al. | |
| 2011/0221835 | A1 | 9/2011 | Maruyama | |
| 2012/0194620 | A1 | 8/2012 | Matsumoto et al. | |
| 2012/0236094 | A1* | 9/2012 | Katoh | B41J 2/17553 347/92 |
| 2013/0033552 | A1 | 2/2013 | Chen et al. | |
| 2016/0288520 | A1 | 10/2016 | Kato et al. | |
| 2017/0151805 | A1* | 6/2017 | Sato | B41J 2/17596 |

FOREIGN PATENT DOCUMENTS

| | | |
|---|---|---|
| WO | 03/041964 | 5/2003 |
| WO | 2010/082310 | 7/2010 |

* cited by examiner

PRESSURIZED PURGE MODE

DECOMPRESSION MODE 3
342
30
32
31
37
35
36
34
XIV
XV
XVI
UP
DOWN
FRONT
REAR
32P
7
44
33
332
341
38

ENLARGEMENT OF PART A1

ENLARGEMENT OF PART A2

ENLARGEMENT OF PART A3

ENLARGEMENT OF PART A4

FIG. 24B ENLARGEMENT OF PART A5

ENLARGEMENT OF PART A6

LIQUID SUPPLY UNIT AND LIQUID INJECTION DEVICE

INCORPORATION BY REFERENCE

This application is based on Japanese Patent Application No. 2018-57663 and 2018-57668 filed with the Japan Patent Office on Mar. 26, 2018 respectively, the contents of which are hereby incorporated by reference.

BACKGROUND

The present disclosure relates to a liquid supply unit for supplying liquid stored in a liquid storage container to a liquid injection head and a liquid injection device to which the liquid supply unit is applied.

For example, in an ink jet printer, a liquid injection head for injecting a tiny amount of ink (liquid) to a print object is used. Ink is supplied to this liquid injection head from an ink cartridge (liquid storage container) storing the ink through a predetermined supply passage. Conventionally, a liquid injection device is known in which a liquid supply unit (valve unit) including a pressure chamber for setting a discharge hole of a liquid injection head to a negative pressure is arranged in a supply passage in the case of supplying ink from an ink cartridge to the liquid injection head by a water head difference. By disposing the liquid supply unit for generating the negative pressure, unlimited dripping of the ink from the discharge hole is suppressed even if the ink is supplied by the water head difference.

A conventional liquid supply unit adopts such a structure that a part of a pressure chamber set to a negative pressure is defined by a flexible film and a pressing plate (pressure receiving plate) attached to this flexible film directly presses a movable valve. The movable valve is biased in a direction opposite to a direction of the pressing by a biasing member. If a negative pressure degree of the pressure chamber increases due to the suction of ink by the liquid injection head, the movable valve is pressed against the pressing plate to move according to a displacement of the flexible film, an ink supply passage into the pressure chamber is opened and the ink flows into the pressure chamber. If the negative pressure degree of the pressure chamber decreases due to this inflow of the ink, the movable valve is moved in a reverse direction by a biasing force of the biasing member and the pressure chamber returns to a sealed state.

SUMMARY

A liquid supply unit according to one aspect of the present disclosure is a liquid supply unit for supplying predetermined liquid from a liquid storage container storing the liquid to a liquid injection head for injecting the liquid. The liquid supply unit includes a first chamber, a second chamber, a wall portion, an opening/closing member, a biasing member, a pressing member and a flexible film member. The first chamber communicates with the liquid storage chamber. The second chamber is arranged downstream of the first chamber in a liquid supply direction and communicates with the liquid injection head. The wall portion includes a communication opening allowing communication between the first chamber and the second chamber. The opening/closing member is arranged in the communication opening and changes a posture between a closing posture for closing the communication opening and an opening posture for opening the communication opening. The biasing member biases the opening/closing member in a direction toward the closing posture. The pressing member is capable of pressing the opening/closing member in a direction toward the opening posture. The flexible film member is displaced based on a negative pressure generated as the liquid in the second chamber decreases, and transmits a displacement force thereof to the pressing member.

The pressing member includes a pivot point, a pressure receiving portion configured to receive the displacement force from the flexible film member and a pressing portion configured to press the opening/closing member against a biasing force of the biasing member, and rotates about the pivot point when the pressure receiving portion receives the displacement force, and the pressing portion presses the opening/closing member by the rotation of the pressing member.

A liquid supply unit according to another aspect of the present disclosure is a liquid supply unit configured similarly to the above, and the pressing member includes a pressure receiving portion configured to receive a displacement force from the flexible film member and a pressing portion configured to press the opening/closing member against a biasing force of the biasing member. The opening/closing member is link-connected to the pressing member at the pressing portion.

A liquid injection device according still another aspect of the present disclosure includes a liquid injection head configured to inject predetermined liquid, the above liquid supply unit configured to supply the liquid from a liquid storage chamber storing the liquid to the liquid injection head, a first supply passage allowing communication between the liquid storage container and the first chamber of the liquid supply unit, and a second supply passage allowing communication between the liquid injection head and the second chamber of the liquid supply unit.

BRIEF DESCRIPTION OF THE DRAWINGS

FIG. 24A is a sectional view showing a state of the backflow prevention mechanism in a print mode and FIG. 24B is an enlarged view of a part A5 of FIG. 24A.

DETAILED DESCRIPTION

[Overall Configuration of Printer]

Figure 1:
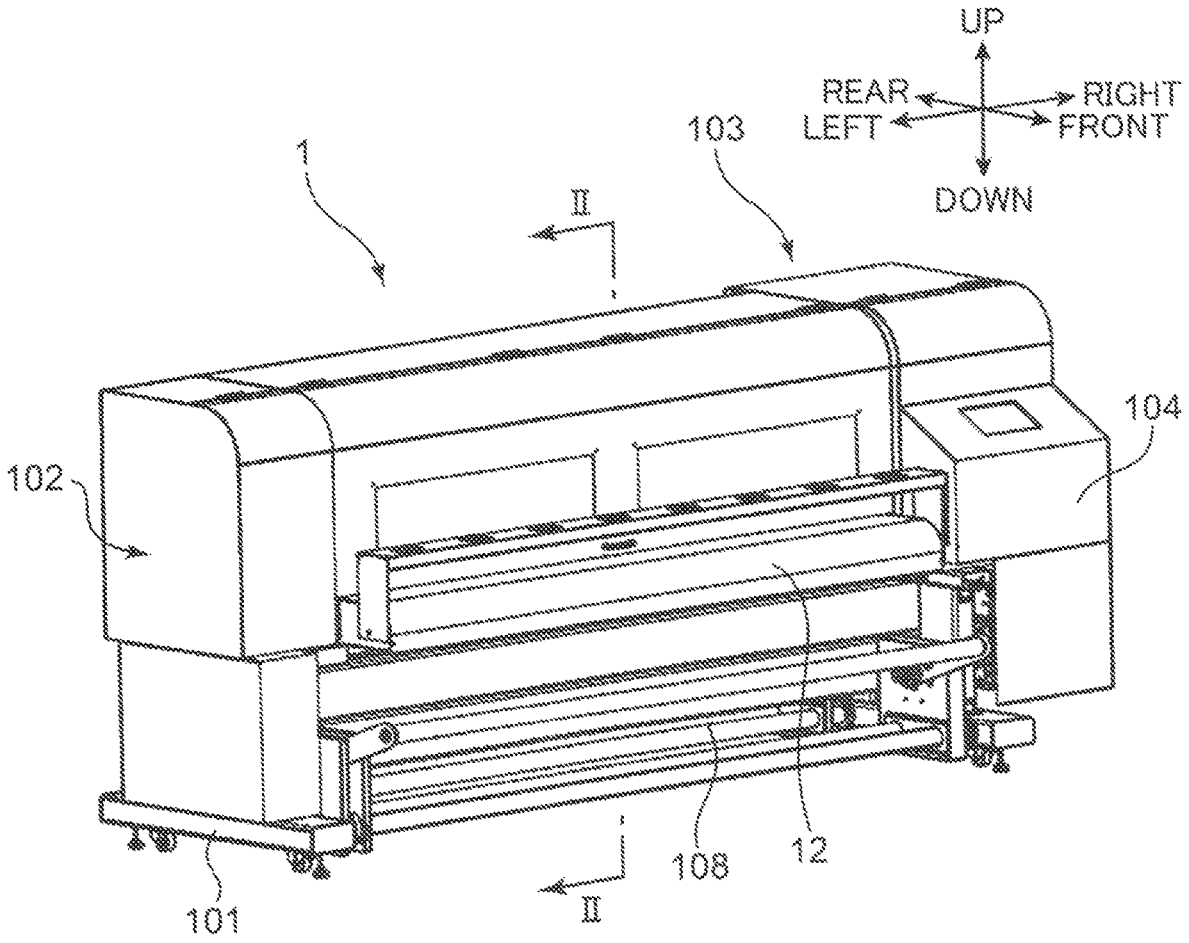
FIG. 1 is a perspective view showing the external appearance of an ink jet printer to which the present disclosure is applied.
Figure 2:
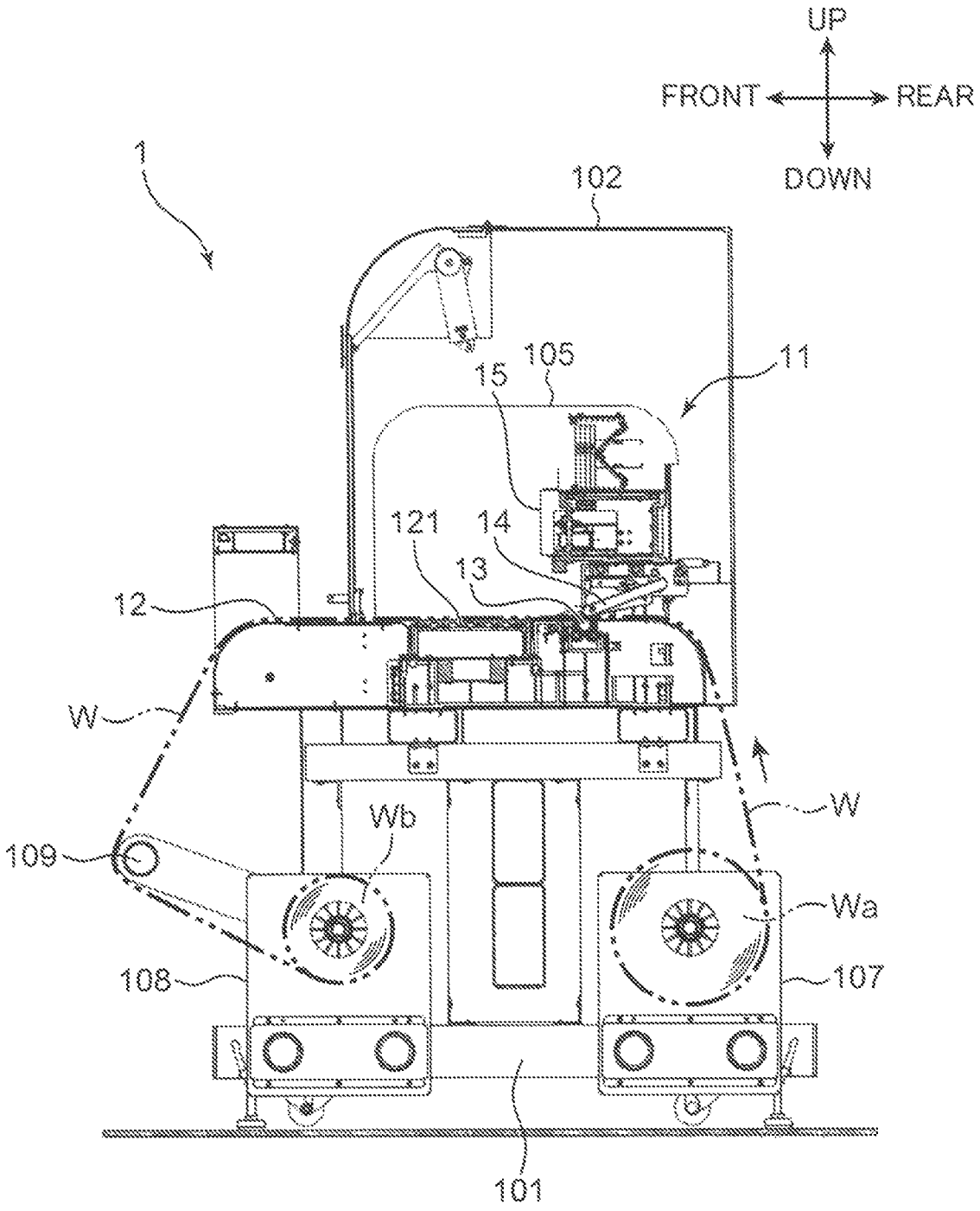
FIG. 2 is a sectional view along line II-II of FIG. 1.
Figure 3:
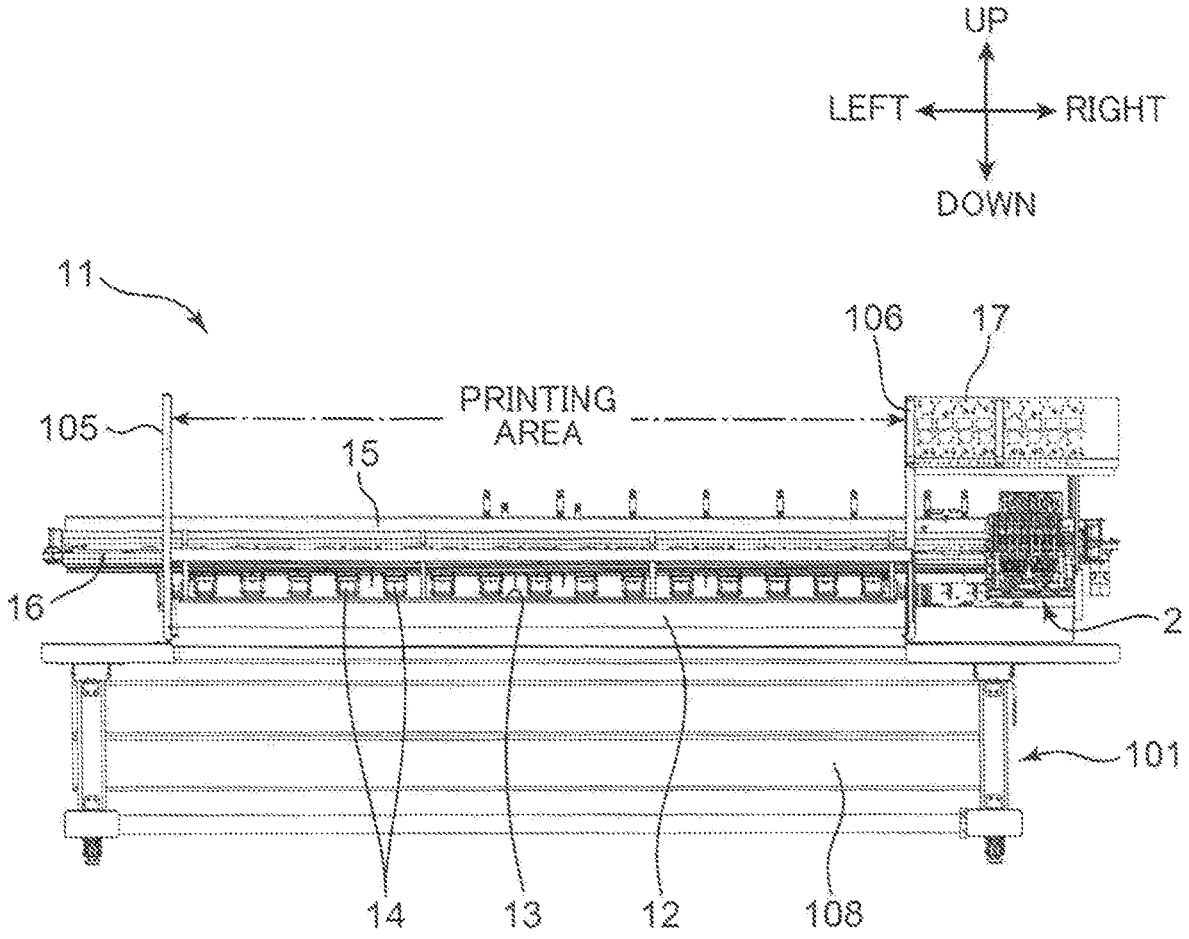
FIG. 3 is a front view of the ink jet printer with an outer cover removed.

Hereinafter, one embodiment of the present disclosure is described with reference to the drawings. First, an ink jet printer to which a liquid supply unit or a liquid injection device according to the present disclosure is applied is described. FIG. 1 is a perspective view showing the external appearance of an ink jet printer 1 according to the embodiment, FIG. 2 is a sectional view along line II-II of FIG. 1, and FIG. 3 is a front view of the printer 1 with an outer cover 102 removed. Note that front-rear, lateral and vertical directions are indicated in FIGS. 1 to 3 and figures described later, but this is only for the convenience of description and not intended to limit directions at all.

The printer 1 is a printer for performing a printing process of printing characters and images on various works W such as paper sheets, resin sheets or cloth fabrics, and particularly a printer suitable for a printing process on large-size and long works. The printer 1 includes a base frame 101 with casters and an apparatus body 11 placed on the base frame 101 and configured to perform the printing process.

The apparatus body 11 includes a work conveyance path 12, a conveyor roller 13, pinch roller units 14 and a carriage 2. The work conveyance path 12 is a conveyance path extending in a front-rear direction for loading a work W, to which the printing process is applied, into the apparatus body 11 from a rear side and unloading the work W from a front side. The conveyor roller 13 is a roller extending in a lateral direction and configured to generate a drive force for intermittently feeding the work W along the work conveyance path 12. The pinch roller unit 14 is arranged to face the conveyor roller 13 from above and includes a pinch roller which forms a conveyance nip together with the conveyor roller 13. A plurality of the pinch roller units 14 are arranged at predetermined intervals in the lateral direction.

The carriage 2 is a movable body on which units for performing the printing process on the work W are mounted and which can reciprocate along the lateral direction on the base frame 101. A carriage guide 15 with a guide rail for guiding reciprocal movements of the carriage 2 stands to extend in the lateral direction on a rear side of the base frame 101. A timing belt 16 is so assembled with the carriage guide 15 as to be able to circulate in the lateral direction. The carriage 2 includes a fixing portion for the timing belt 16, and moves in the lateral direction while being guided by the guide rail as the timing belt 16 circulates in a forward or reverse direction.

The printing process is performed by intermittently feeding the work W by the conveyor roller 13 and the pinch roller units 14 and moving the carriage 2 in the lateral direction while the work W is stopped to print and scan the work W. Note that, in the work conveyance path 12, a platen 121 (see FIG. 2) additionally provided with a function of sucking the work W is arranged below a passage path of the carriage 2. During the printing process, the carriage 2 performs printing and scanning with the work W sucked to the platen 121.

The apparatus body 11 is covered by an outer cover 102. A side station 103 is arranged in a region to the right of the outer cover 102. An immovable ink cartridge shelf 17 for holding ink cartridges IC (FIGS. 5 and 6) for storing ink (predetermined liquid) for the printing process is housed in the side station 103.

A carriage retraction area 104 serving as a retraction space for the carriage 2 is present in a front part of the side station 103. As shown in FIG. 3, a left frame 105 and a right frame 106 stand on the base frame 101 while being spaced apart in the lateral direction by a distance corresponding to the work conveyance path 12. An area between these left and right frames 105, 106 serves as a printing area where the printing process can be performed. The carriage guide 15 has a lateral width longer than the printing area, and the carriage 2 is movable to a right outer side of the printing area. When the printing process is not performed, the carriage 2 is retracted to the carriage retraction area 104. Further, a pressurized purge process to be described later is also performed in this carriage retraction area 104.

A feeding unit 107 housing a feed roll Wa, which is a winding body of the work W having the printing process applied thereto, is provided on a rear side of the base frame 101. Further, a winding unit 108 housing a winding roll Wb, which is a winding body of the work W after the printing process, is provided on a front side of the base frame 101.

The winding unit 108 includes an unillustrated drive source for rotationally driving a winding shaft of the winding roll Wb, and winds the work W while applying predetermined tension to the work W by a tension roller 109.

[Configuration of Carriage]

Figure 4:
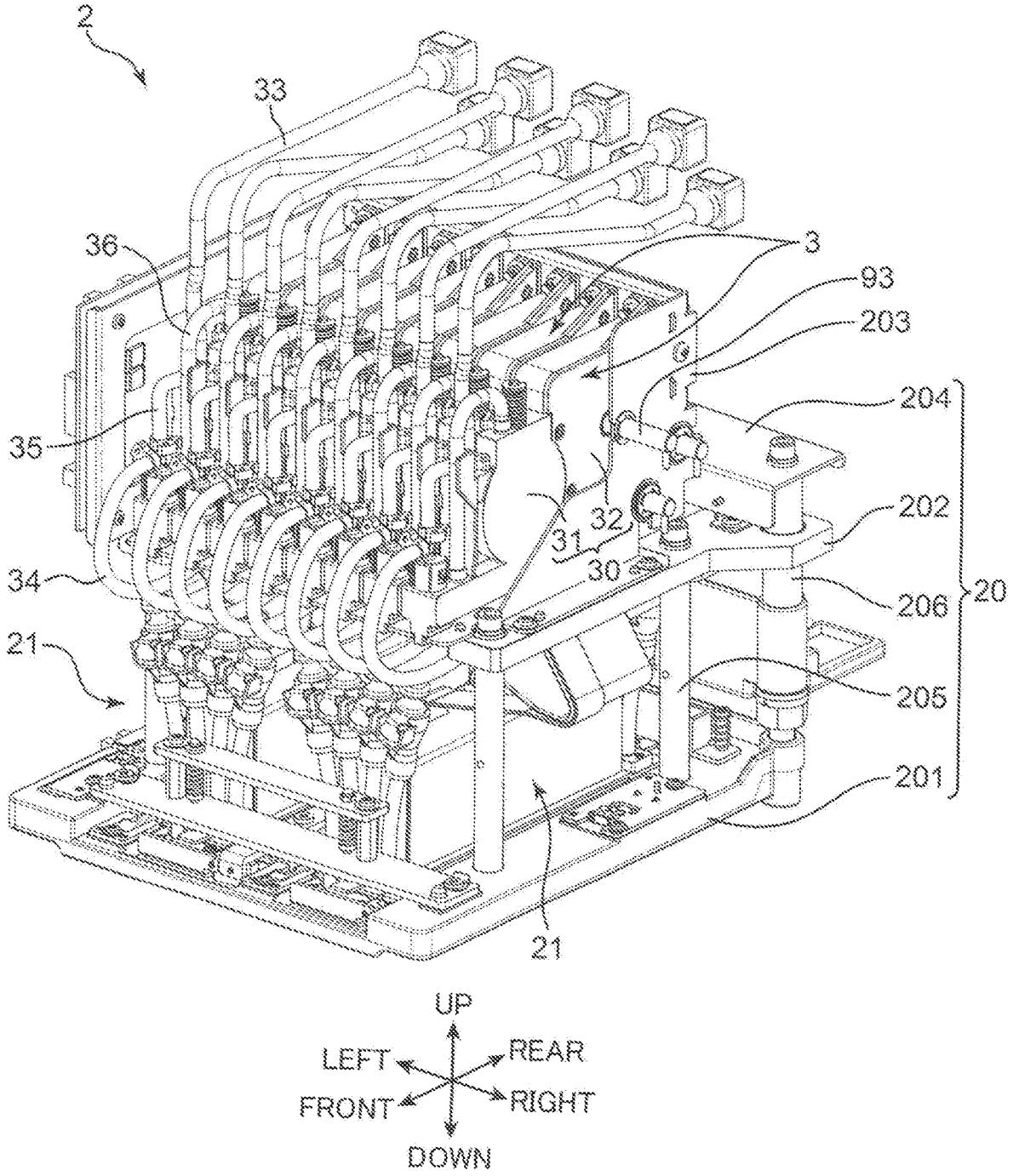
FIG. 4 is an overall perspective view of a carriage mounted in the ink jet printer.

FIG. 4 is an overall perspective view of the carriage 2. Head units 21 (liquid injection heads) for injecting the ink (liquid) to the work W and liquid supply units 3 for supplying the ink from the ink cartridges IC to the head units 21 are mounted on the carriage 2. FIG. 4 shows an example in which two head units 21 and eight liquid supply units 3 are mounted on the carriage 2. Specifically, four liquid supply units 3 are equipped for each head unit 21 to supply respective inks of cyan, magenta, yellow and black. Note that the ink of a different color is filled into each liquid supply unit 3, and inks of at most eight colors may be injected from the two head units 21.

The carriage 2 includes the head units 21 and a carriage frame 20 for holding the head units 21. The carriage frame 20 includes a lower frame 201 located at a lowermost position, an upper frame 202 arranged above and at a distance from the lower frame 201, a rack 203 mounted on the upper surface of the upper frame 202 and a back surface frame 204 mounted on the rear surface of the upper frame 202. The lower frame 201 and the upper frame 202 are coupled by coupling support columns 205 extending in the vertical direction. An unillustrated ball screw mechanism is mounted on the back surface frame 204, and a nut portion driven by that ball screw is mounted on the lower frame 201. Further, the back surface frame 204 is provided with guiding support columns 206 extending in the vertical direction. By the drive of the ball screw mechanism, a coupled body of the lower frame 201 and the upper frame 202 can move in the vertical direction while being guided by the guiding support columns 206. That is, a body part of the carriage 2 is movable in the vertical direction with respect to the back surface frame 204.

The head units 21 are mounted on the lower frame 201. Since the body part of the carriage 2 is movable in the vertical direction as described above, vertical height positions of the head units 21 with respect to the work W are adjustable. The liquid supply units 3 are mounted on the upper frame 202. The eight liquid supply units 3 are supported on the upper frame 202 while being aligned in the lateral direction in the rack 203. A guided portion to be guided by the guide rail of the carriage guide 15, a fixing portion to the timing belt 16 and the like are provided on the back surface frame 204.

Figure 5:
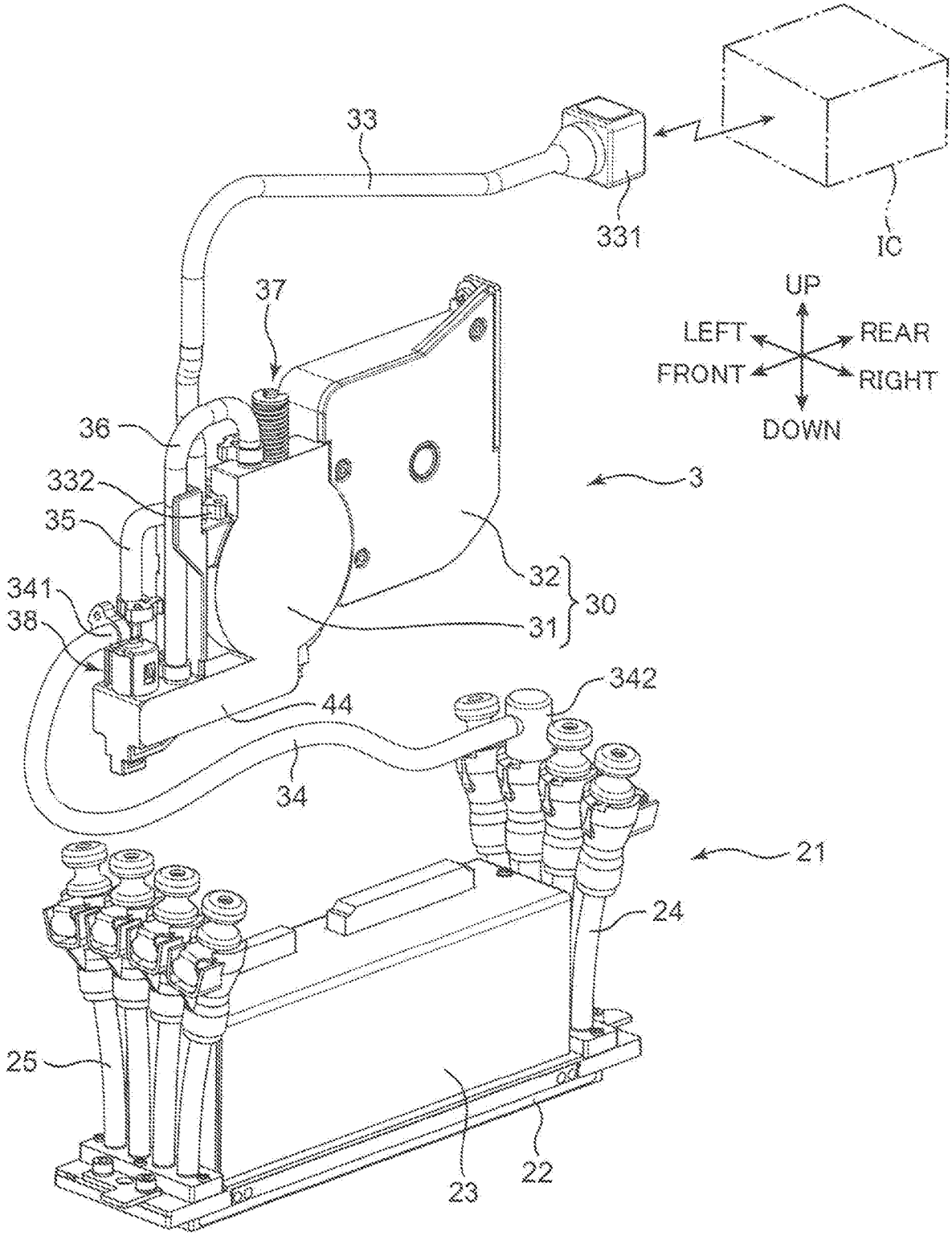
FIG. 5 is a perspective view showing one liquid supply unit and one head unit.

FIG. 5 is a perspective view showing one liquid supply unit 3 and one head unit 21. The liquid supply unit 3 includes a body portion 30 with a tank portion 31 and a pump portion 32, an upstream pipe 33 (first supply passage) arranged on an upstream side of the body portion 30 in an ink supply direction (liquid supply direction), a downstream pipe 34 (second supply passage) arranged on a downstream side of the body portion 30, and a bypass pipe 35.

The tank portion 31 is a region forming a space for temporarily storing the ink to be supplied to the head unit 21 under a negative pressure environment. The pump portion 32 is a region for housing a pump 9 (FIG. 6) to be operated during a decompression process for forming the negative pressure environment and a pressurized purge process for cleaning the head unit 21 (ink discharging portion 22).

The upstream pipe 33 is a supply pipe allowing communication between the tank portion 31 and the ink cartridge IC (liquid storage container). An upstream end 331 of the upstream pipe 33 is connected to a terminal end part of a tube (not shown) extending from the ink cartridge IC, and a downstream end 332 is connected to an inlet part of the tank portion 31. The downstream pipe 34 is a supply pipe allowing communication between the tank portion 31 and the head unit 21. An upstream end 341 of the downstream pipe 34 is connected to an outlet part of the tank portion 31 and a downstream end 342 is connected to the head unit 21. The bypass pipe 35 is a conduit for feeding the ink to the downstream pipe 34 without via the negative pressure environment (second chamber 42 to be described later) of the tank portion 31.

The head unit 21 includes the ink discharging portion 22, a control unit 23, an end tube 24 and a discharge tube 25. The ink discharging portion 22 is a nozzle part for discharging ink droplets toward the work W. A piezo method using a piezo element, a thermal method using a heating element or the like can be adopted as a method for discharging ink droplets in the ink discharging portion 22. The control unit 23 includes a control board for controlling the piezo element or the heating element provided in the ink discharging portion 22 and controls an operation of discharging ink droplets from the ink discharging portion 22.

The end tube 24 is a tube linking the downstream end 342 of the downstream pipe 34 and the ink discharging portion 22. The downstream end 342 is a cap-type socket and attachable to an upper end fitting part of the end tube 24 in a single operation. The discharge tube 25 is a tube for discharging preservation solution sealed in the liquid supply unit 3 during initial usage. During initial usage, the downstream end 342 of the downstream pipe 34 is attached to the upper end fitting part of the end tube 24 and a separate tube is connected to the discharge tube 25 to open a storage space for the preservation solution, whereby an operation of discharging the preservation solution is performed.

[Summary of Liquid Supply System]

In this embodiment, the device is configured such that the ink cartridge IC is arranged above the head unit 21 and the ink is supplied to the head unit 21 by a water head difference. In the case of supplying the ink by the water head difference, the ink is constantly discharged from the ink discharging portion 22 of the head unit 21 if the ink is supplied at normal pressure. Thus, it is necessary to dispose a negative pressure generating portion for generating a negative pressure environment in the ink supply path and set the ink discharging portion 22 to a suitable negative pressure. The tank portion 31 of the liquid supply unit 3 functions as the above negative pressure generating portion.

Figure 6:
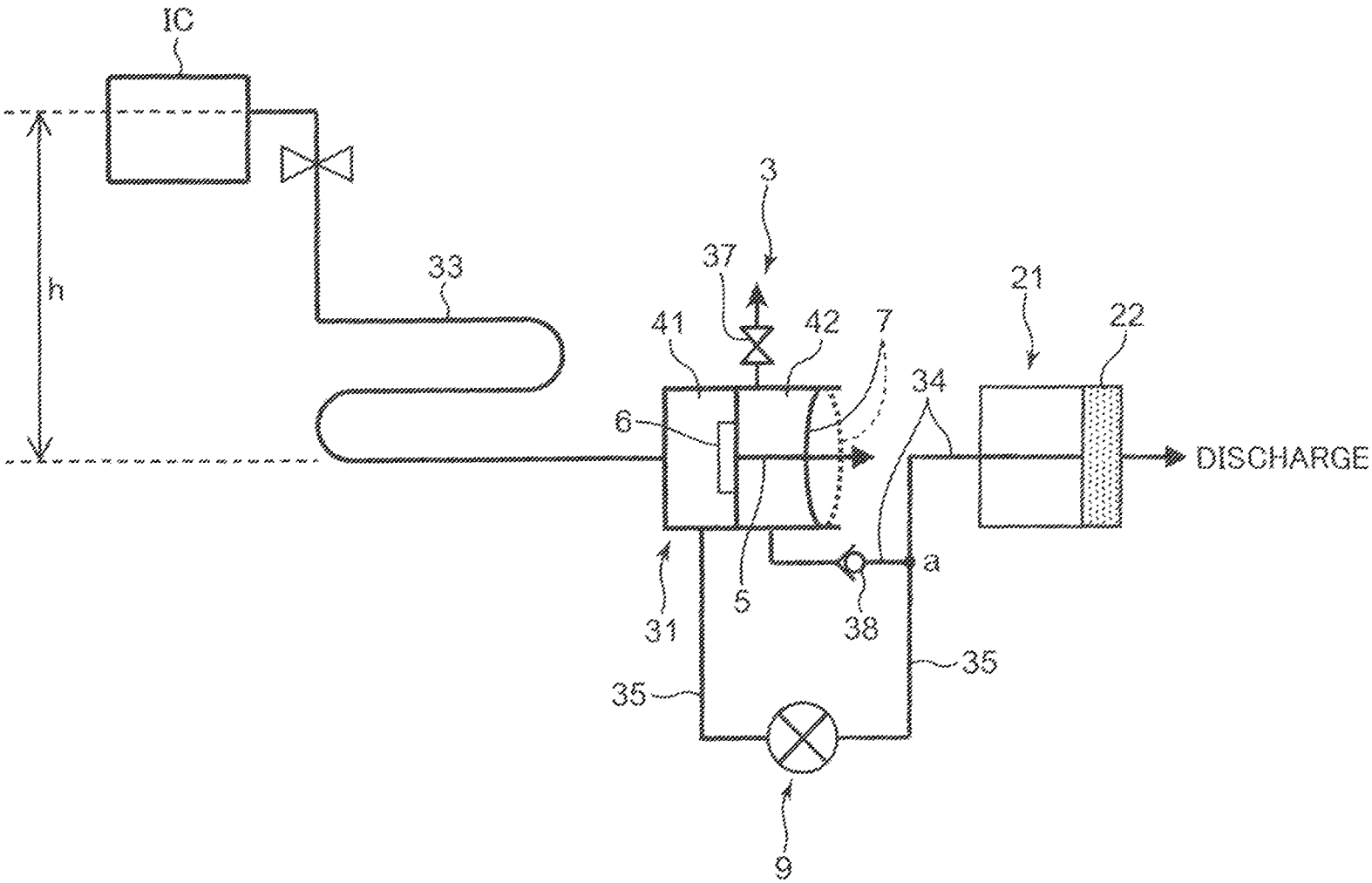
FIG. 6 is a block diagram showing a liquid supply system in an embodiment showing a state where a print mode is being performed.

FIG. 6 is a block diagram schematically showing the liquid supply system adopted in the carriage 2 of this embodiment. The ink cartridge IC is arranged at a position higher than the ink discharging portion 22 by a height h. This height h serves as the water head difference and the ink in the ink cartridge IC is supplied to the head unit 21 by this water head difference. The liquid supply unit 3 is incorporated at an intermediate position of the ink supply path between the ink cartridge IC and the head unit 21. The tank portion 31 of the liquid supply unit 3 includes a first chamber 41 set to a pressure higher than an atmospheric pressure by receiving the water head difference and the second chamber 42 arranged downstream of the first chamber 41 in the ink supply direction and set to a negative pressure. The first chamber 41 is a chamber in which a negative pressure operation is not performed and to which a pressure P by the water head difference is applied in addition to the atmospheric pressure. This pressure P is expressed by $P=\rho gh$ [Pa] when $\rho$ denotes water density (ink can be handled equivalent to water in density), g denotes a gravitational acceleration and h denotes the water head difference. The first chamber 41 communicates with the ink cartridge IC via the upstream pipe 33. The second chamber 42 communicates with the ink discharging portion 22 via the downstream pipe 34.

An on-off valve 6 (opening/closing member) coupled to a pressing member 5 is arranged on a wall surface partitioning between the first chamber 41 and the second chamber 42. Further, a wall portion defining the second chamber 42 is partially constituted by an atmospheric pressure detection film 7 (flexible film member). When a pressure in the second chamber 42 reaches a negative pressure exceeding a predetermined threshold value, the atmospheric pressure detection film 7 detects the atmospheric pressure to be displaced. This displacement force is applied to the pressing member 5, a posture of the on-off valve 6 coupled to the pressing member 5 changes from a closing posture to an opening posture, and the first chamber 41 and the second chamber 42 are allowed to communicate. An ink supply route during a normal printing process is a route passing through the upstream pipe 33, the first chamber 41, the second chamber 42 and the downstream pipe 34. In addition to this, the bypass pipe 35 for short-circuiting the first chamber 41 and the downstream pipe 34 without via the second chamber 42 is provided. The pump 9 capable of rotating in forward and reverse rotation directions is arranged in the bypass pipe 35.

FIG. 6 is also a diagram showing a state where the liquid supply system is performing a print mode (during normal liquid supply) for performing the printing process. In the print mode, a predetermined amount of the ink is filled in each of the first and second chambers 41, 42 and the second chamber 42 is set to a predetermined negative pressure. The pressure in the first chamber 41 is the atmospheric pressure+ $\rho gh$ [Pa] due to the water head difference as described above and the ink can be supplied from the ink cartridge IC by the water head difference any time. As basic setting of the print mode, the on-off valve 6 is set in the closing posture and the first and second chambers 41, 42 are separated. The pump 9 is in a stopped state. Although described later, the pump 9 is a tube pump and the bypass pipe 35 is in a closed state when the pump 9 is stopped. Thus, the downstream pipe 34 and the ink discharging portion 22 are also maintained at the negative pressure.

To smoothly fill the ink into the second chamber 42, an air vent mechanism 37 is attached to the second chamber 42. A predetermined amount of the ink needs to be initially filled into the second chamber 42 during initial usage, after maintenance and the like. The air vent mechanism 37 promotes the initial filling by allowing the second chamber 42 set in the negative pressure environment to temporarily communicate with the atmosphere (by venting air in the second chamber 42). Further, the ink stored in the second chamber 42 may generate air bubbles by heating. The air vent mechanism 37 is also used in removing air based on the air bubbles from the second chamber 42.

When the head unit 21 operates and the ink discharging portion 22 discharges ink droplets, the ink in the second chamber 42 is consumed and, accordingly, a degree of the negative pressure in the second chamber 42 progresses. That is, the ink discharging portion 22 sucks the ink from the second chamber 42 in a state separated from the atmosphere and enhances a negative pressure degree of the second chamber 42 every time discharging ink droplets. When the pressure in the second chamber 42 reaches a negative pressure exceeding the predetermined threshold value as the ink in the second chamber 42 decreases, the atmospheric pressure detection film 7 detects the atmospheric pressure to be displaced as described above. By this displacement force, the posture of the on-off valve 6 changes from the closing posture to the opening posture through the pressing member 5 and the first and second chambers 41, 42 communicate. Thus, the ink flows from the first chamber 41 into the second chamber 42 due to a pressure difference between the both chambers.

As the ink flows into the second chamber 42, the negative pressure degree of the second chamber 42 is gradually alleviated and approaches the atmospheric pressure. Simultaneously, the displacement force applied to the pressing member 5 from the atmospheric pressure detection film 7 also becomes gradually smaller. When the pressure in the second chamber 42 reaches a negative pressure below the predetermined threshold valve, the posture of the on-off valve 6 returns to the closing posture and the first and second chambers 41, 42 are separated again. At this time, the ink is replenished into the first chamber 41 from the ink cartridge IC by the water head difference by an amount flowed into the second chamber 42 from the first chamber 41. In the print mode, such an operation is repeated.

The liquid supply system of this embodiment is capable of performing the pressurized purge mode and a decompression mode in addition to the above print mode. The pressurized purge mode is a mode for supplying high-pressure ink to the ink discharging portion 22 and causing the ink discharging portion 22 to discharge the ink in order to recover or prevent ink clogging. The decompression mode is a mode for setting the second chamber 42 at normal pressure to the predetermined negative pressure during initial usage, after maintenance and the like.

Figure 7A:
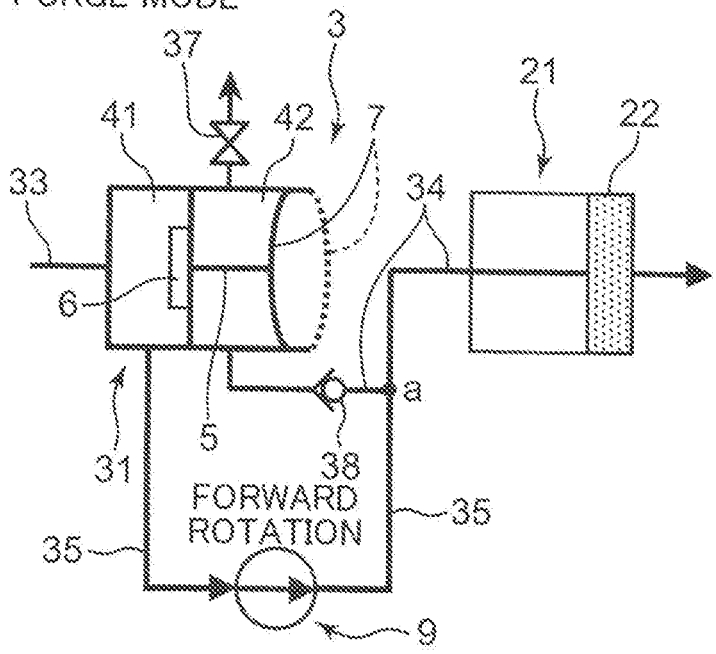
FIG. 7A is a diagram showing a state where a pressurized purge mode is being performed and FIG. 7B is a diagram showing a state where a decompression mode is being performed.

FIG. 7A is a diagram showing a state where the pressurized purge mode is being performed. In the pressurized purge mode, the pump 9 is driven in the forward rotation direction. By the forward drive of the pump 9, the ink directly moves from the upstream pipe 33 toward the downstream pipe 34 via the first chamber 41 and the bypass pipe 35 while bypassing the second chamber 42. That is, the ink pressurized in the pump 9 is supplied to the ink discharging portion 22. In this way, the ink is forcibly discharged from the ink discharging portion 22 to clean the ink discharging portion 22. Note that an operation similar to that in the pressurized purge mode is also performed when the preservation solution sealed in the liquid supply unit 3 is discharged during initial usage.

A backflow prevention mechanism 38 is provided to prevent the pressurized ink from flowing back to the second chamber 42 through the downstream pipe 34 when the pressurized purge mode is performed. The backflow prevention mechanism 38 is arranged in the downstream pipe 34 on a side upstream of a joint part a of the downstream pipe 34 and a downstream end of the bypass pipe 35. Since a side of the downstream pipe 34 upstream of the joint part a is closed by the backflow prevention mechanism 38, all the high-pressure ink generated in the bypass pipe 35 flows toward the ink discharging portion 22. Thus, the breakage of the atmospheric pressure detection film 7 defining the second chamber 42 is prevented.

Figure 7B:
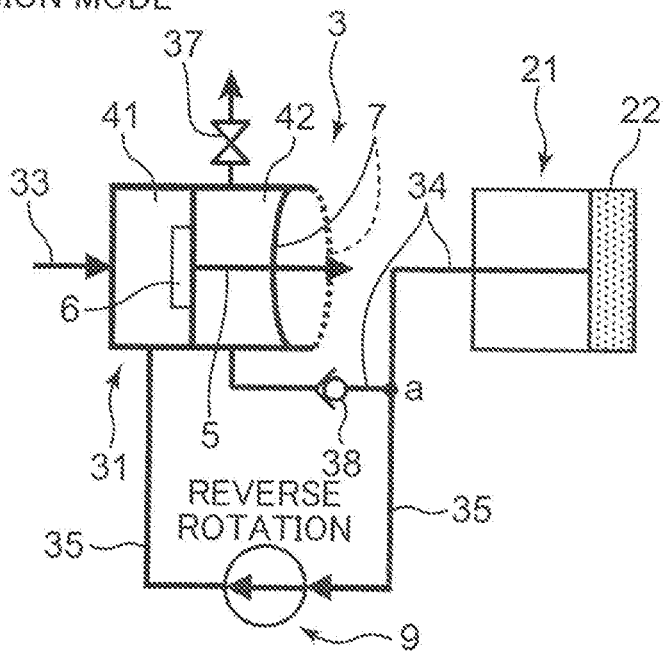

FIG. 7B is a diagram showing a state where the decompression mode is being performed. In the decompression mode, the pump 9 is driven in the reverse rotation direction. When the pump 9 is driven in the reverse rotation direction, the ink discharging portion 22 and the second chamber 42 are decompressed through the downstream pipe 34 and the bypass pipe 35. The ink discharging portion 22 and the second chamber 42 are set to a predetermined negative pressure, i.e. a negative pressure at which ink droplets do not leak from the ink discharging portion 22 even if the ink is supplied by the water head difference, by this decompression mode. Note that if the ink discharging portion 22 is set to an excessive negative pressure, ink discharge by the drive of the piezo element or the like in the ink discharging portion 22 may be impeded. Thus, the ink discharging portion 22 and the second chamber 42 are desirably set, for example, to a weak negative pressure of about −0.2 to −0.7 kPa.

[Overall Structure of Liquid Supply Unit]

Figures 8A, 8B, 8C:
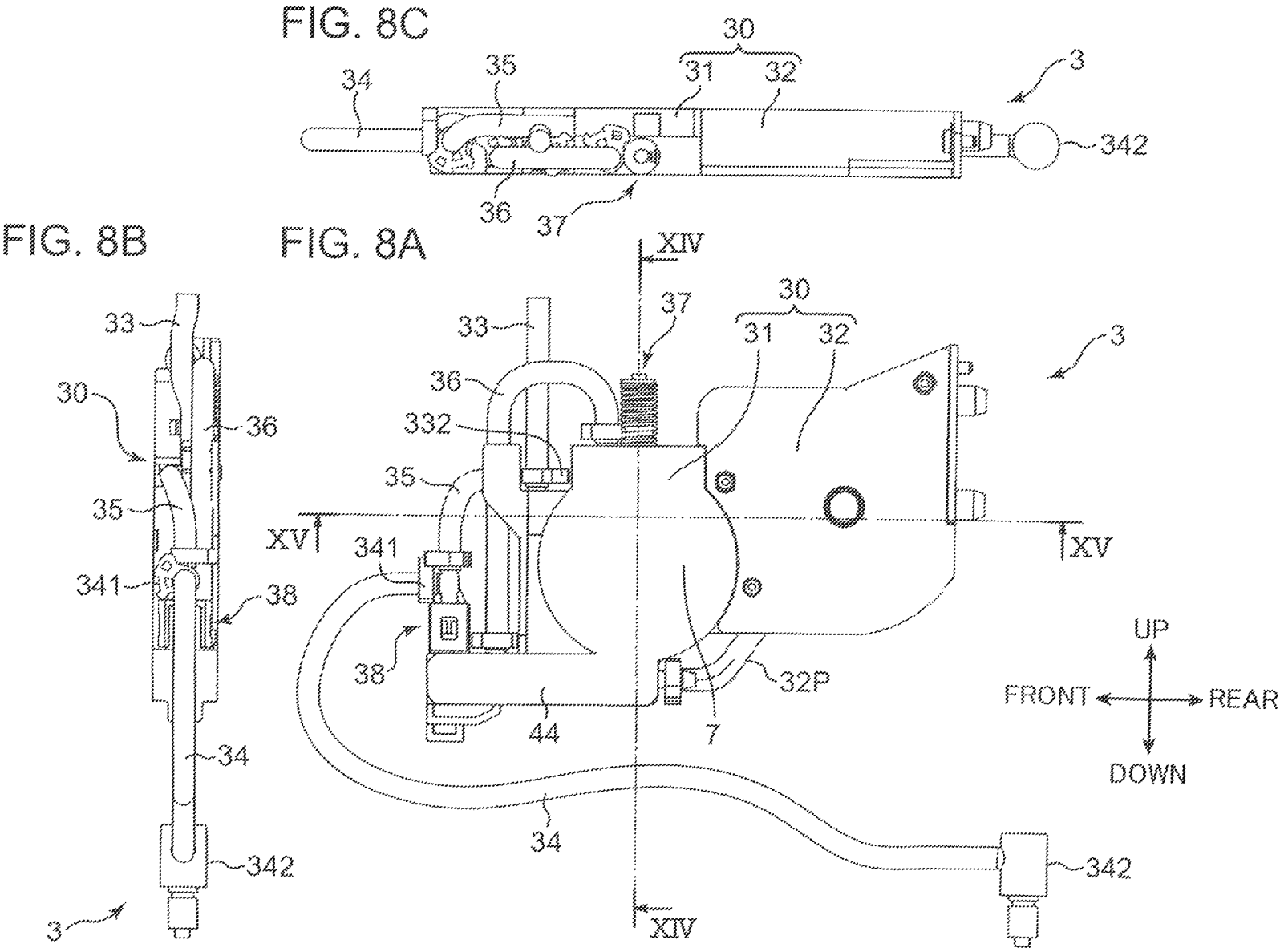
FIG. 8A is a front view of the liquid supply unit.
FIG. 8B is a side view thereof and FIG. 8C is a top view thereof.
Figure 9:
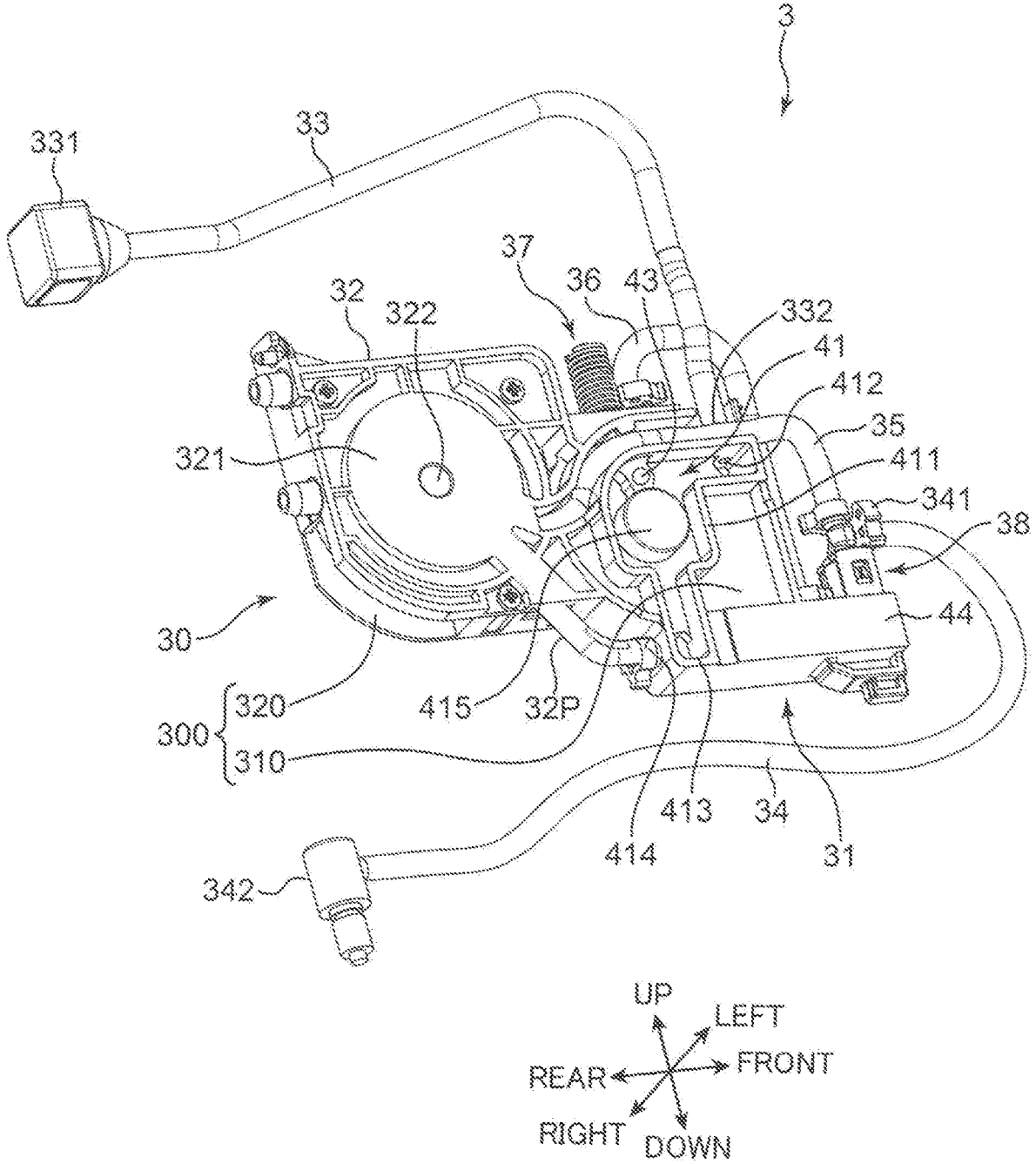
FIG. 9 is a perspective view showing an internal structure of the liquid supply unit.
Figure 10:
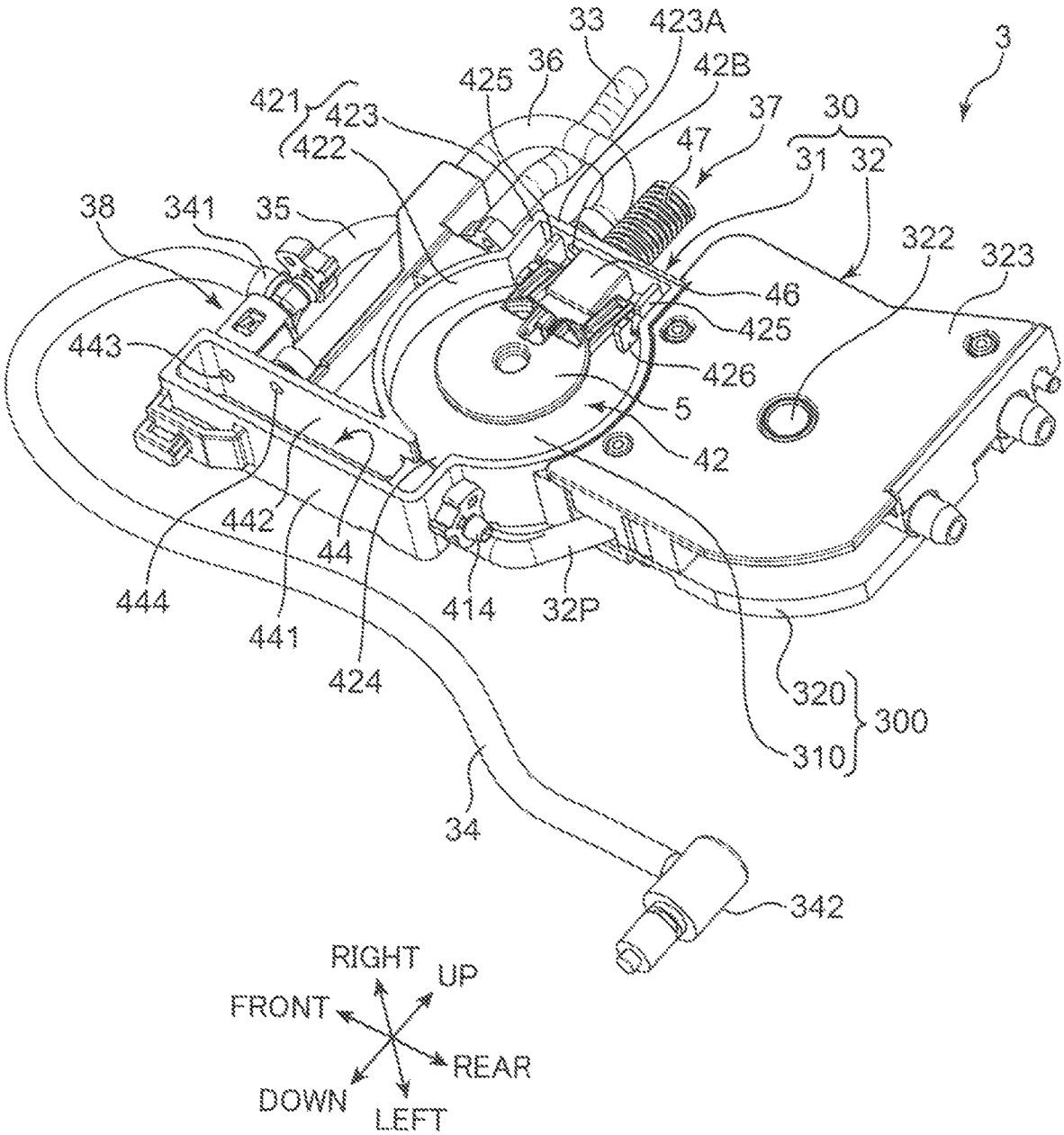
FIG. 10 is a perspective view showing the internal structure of the liquid supply unit.
Figure 11A:
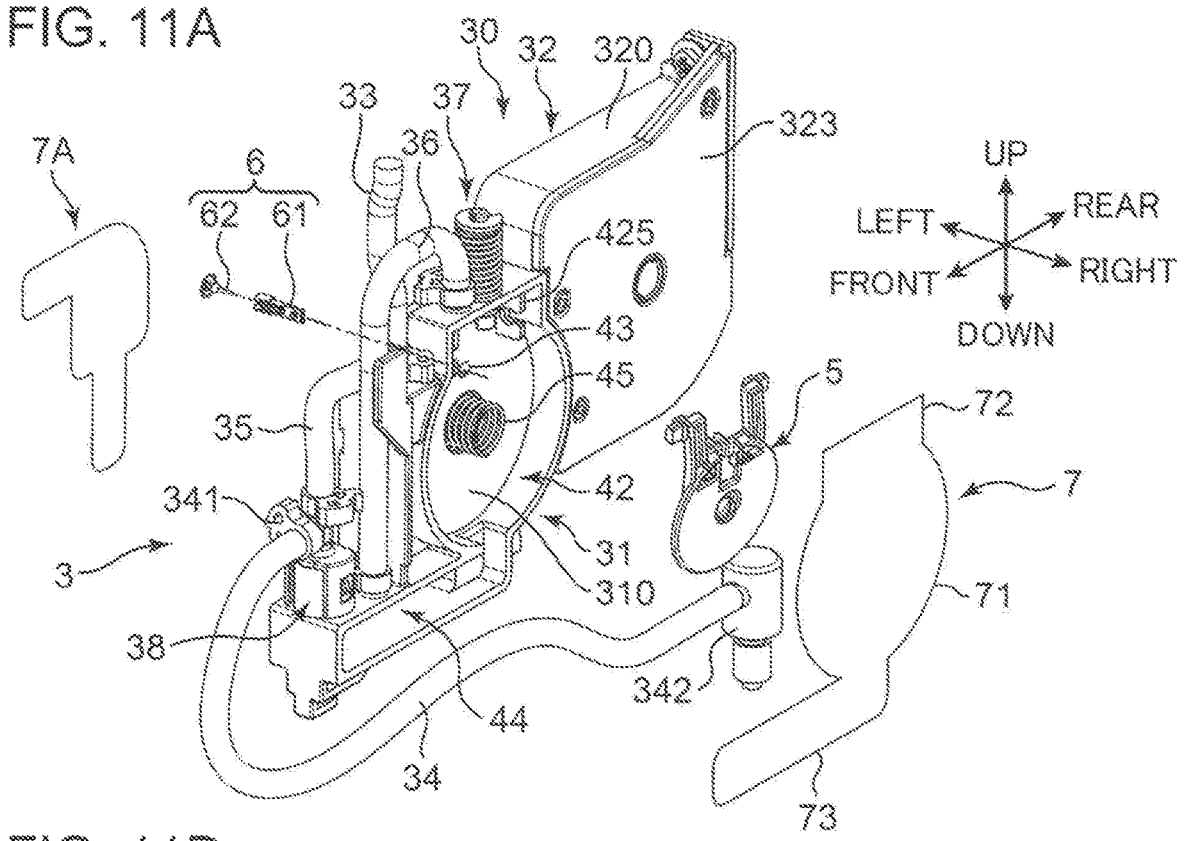
FIG. 11A is an exploded perspective view of the liquid supply unit and FIG. 11B is an exploded perspective view of the liquid supply unit obliquely viewed in a different direction.
Figure 11B:
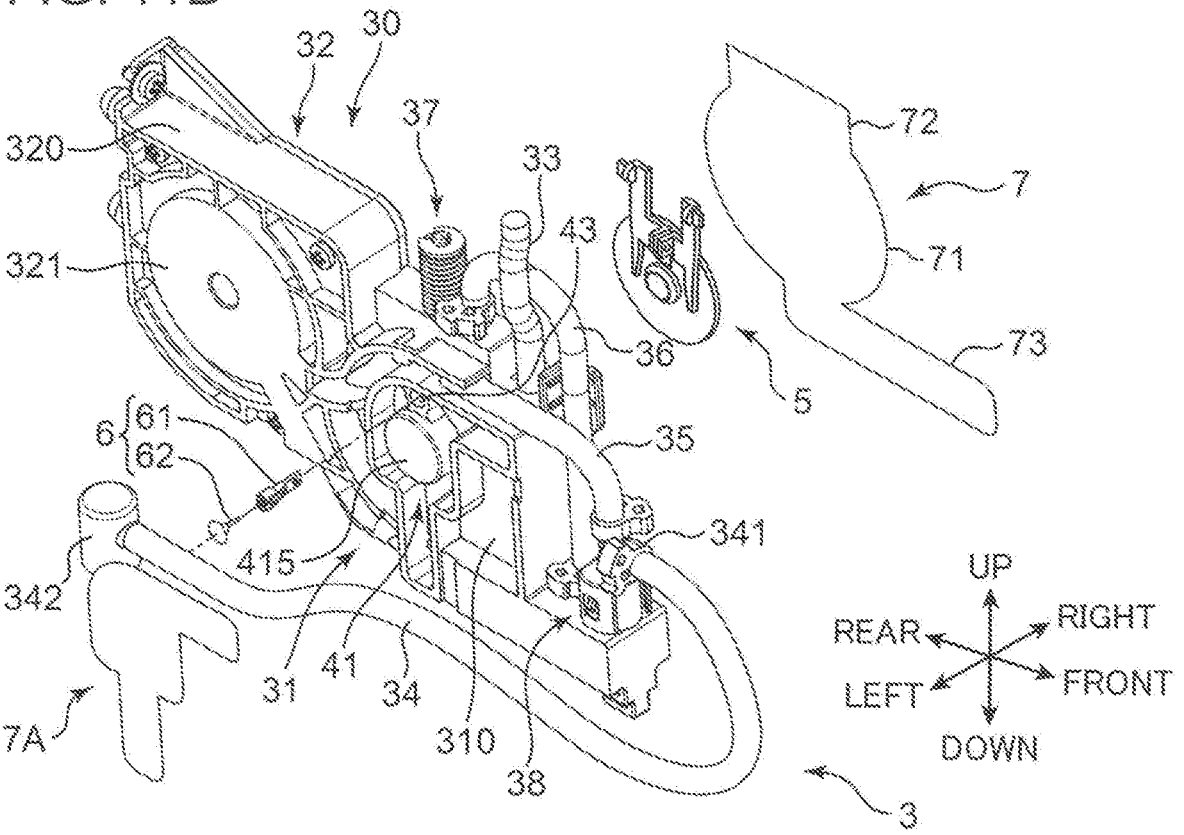

Next, the structure of the liquid supply unit 3 according to this embodiment which enables the execution of each mode of the liquid supply system described above is described in detail. FIG. 8A is a front view of the liquid supply unit 3, FIG. 8B is a side view thereof and FIG. 8C is a top view thereof. FIGS. 9 and 10 are perspective views showing an internal structure of the liquid supply unit 3 on the side of the first chamber 41 and on the side of the second chamber 42. FIGS. 11A and 11B are exploded perspective views of the liquid supply unit 3 viewed from the side of the second chamber 42 and from the side of the first chamber 41.

As preliminarily described on the basis of FIGS. 5 to 7B, the liquid supply unit 3 includes the body portion 30 having the tank portion 31 and the pump portion 32, the upstream pipe 33, the downstream pipe 34, the bypass pipe 35, the air vent mechanism 37, the backflow prevention mechanism 38, the pressing member 5, the on-off valve 6 and the atmospheric pressure detection film 7. Besides these, the liquid supply unit 3 includes a monitor pipe 36 for monitoring an ink liquid surface in the second chamber 42, a communication pipe 32P allowing communication between the pump portion 32 and the first chamber 41 and a sealing film 7A constituting a part of a wall surface defining the first chamber 41.

The body portion 30 includes a base board 300 (see also FIGS. 9, 10 and 22) formed of a flat plate extending in the front-rear direction. A front side of the base board 300 is a tank portion base plate 310 (wall portion) serving as a board of the tank portion 31 and a rear side thereof is a pump portion housing 320 forming a housing structure in the pump portion 32. The first chamber 41 is arranged on a left surface side of the tank portion base plate 310, and the second chamber 42 is arranged on a right surface side thereof. The tank portion base plate 310 is perforated to form a communication opening 43 allowing communication between the first chamber 41 and the second chamber 42. The aforementioned on-off valve 6 is arranged in this communication opening 43.

As shown in FIG. 9, the first chamber 41 is roughly L-shaped in a plan view. The first chamber 41 is defined by a first partition wall 411 projecting leftward from the tank portion base plate 310. An inflow opening 412 for the ink is perforated in an uppermost part of the first partition wall 411. An inflow port 417 (FIG. 22) formed of a receiving plug stands on an outer side surface of the first partition wall 411 in correspondence with the inflow opening 412 for the ink. The downstream end 332 of the upstream pipe 33 is inserted and connected to this inflow port 417. That is, the inflow opening 412 is an opening allowing communication between the ink cartridge IC and the first chamber 41, and the ink flows into the first chamber 41 through this inflow opening 412 by the water head difference.

A bottom wall portion 413 of the first partition wall 411 is located on the lower end of the tank portion base plate 310. A purge port 414 is provided in a rear side wall of the first partition wall 411 near the bottom wall portion 413. An upstream end of the communication pipe 32P is connected to this purge port 414. A spring seat 415 formed of a hollow cylindrical cavity projects near a vertical center of the first chamber 41. The spring seat 415 is a cavity for housing a biasing spring 45 to be described later, and open toward the second chamber 42.

The communication opening 43 is located above the spring seat 415 in the first chamber 41. As already described, the first chamber 41 is a chamber in which the decompression process and the like are not performed and to which the pressure $P=\rho gh$ by the water head difference is applied in addition to the atmospheric pressure. When the ink flows through the inflow opening 412, the ink starts being pooled from the bottom wall portion 413. When an ink liquid level exceeds the communication opening 43, the ink can be supplied into the second chamber 42 through this communication opening 43. Further, when the pump 9 is operated, the ink stored in the first chamber 41 is sucked through the purge port 414 and the communication pipe 32P and the pressurized ink is supplied to the head unit 21 through the bypass pipe 35 and the downstream pipe 34.

Figure 22:
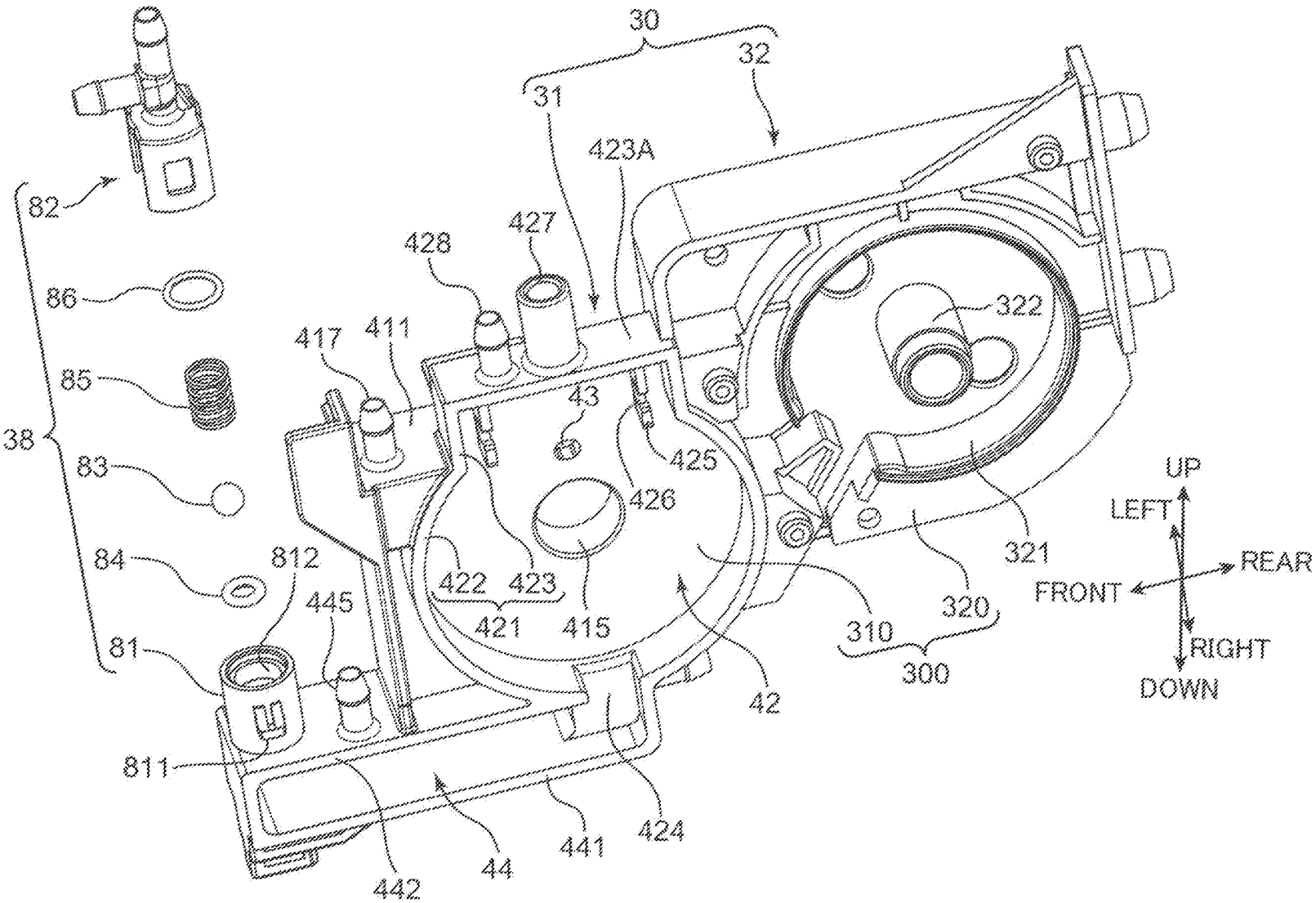
FIG. 22 is an exploded perspective view of a backflow prevention mechanism of the liquid supply unit.

With reference to FIGS. 10 and 22, the second chamber 42 roughly has a circular shape in a plan view. The second chamber 42 is defined by a second partition wall 421 projecting rightward from the tank portion base plate 310. The second partition wall 421 includes a hollow cylindrical wall 422 having a hollow cylindrical shape and an upper wall 423 formed of a rectangular part projecting further upward than the hollow cylindrical wall 422. The aforementioned spring seat 415 is recessed in the tank portion base plate 310 at a center position of a region surrounded by the hollow cylindrical wall 422, i.e. at a position concentric with the hollow cylindrical wall 422. The communication opening 43 is arranged on the spring seat 415 on a vertical line passing through a center point of the spring seat 415.

A communication chamber 44 is connected to the lower end of the second chamber 42. The communication chamber 44 is a rectangular space elongated in the front-rear direction and extends straight forward from the lower end of the hollow cylindrical wall 422. The communication chamber 44 is defined by a wall portion 441. A lower passage 424 allowing communication between the second chamber 42 and the communication chamber 44 is provided on the lower end of the hollow cylindrical wall 422. The wall portion 441 is linked to the hollow cylindrical wall 422 at the position of the lower passage 424. The communication chamber 44 is a space linking the second chamber 42 and the downstream pipe 34 and set to a negative pressure, and substantially constitutes a part of the second chamber 42.

In a region surrounded by the upper wall 423 of the second chamber 42, a pair of front and rear supporting plates 425 project rightward from the tank portion base plate 310. Each of the pair of supporting plates 425 includes a pivotally supporting portion 426 for pivotally supporting the pressing member 5 to be described later. A boss portion 427 and an upper monitor port 428 project upward on a top wall 423A constituting an uppermost part of the upper wall 423 (defining a top wall of the second chamber 42). The boss portion 427 internally includes a boss hole 42A (FIG. 19A), which is an opening allowing the second chamber 42 to communicate with the atmosphere. This boss portion 427 constitutes a part of the air vent mechanism 37, and a lever member 46 and a return spring 47 (FIG. 19A) to be described later are assembled therewith.

On the top wall 423A, an upper monitor hole 42B is perforated in front of the boss hole 42A. Further, a top wall 442 of the wall portion 441 defining the communication chamber 44 is perforated with a lower monitor hole 444. The upper monitor port 428 stands on the top wall 423A in correspondence with the upper monitor hole 42B. A lower monitor port 445 stands on the top wall 442 in correspondence with the lower monitor hole 444. The upper end of the monitor pipe 36 is connected to the upper monitor port 428, and the lower end thereof is connected to the lower monitor port 445. That is, the monitor pipe 36 communicates with upper and lower end sides of the second chamber 42 and the ink liquid level in the monitor pipe 36 is linked with that in the second chamber 42.

In this embodiment, the monitor pipe 36 is formed of a transparent resin tube. Accordingly, a user can know the ink liquid level in the second chamber 42 by seeing the monitor pipe 36. In this embodiment, as shown in FIG. 4, the plurality of liquid supply units 3 are arranged in parallel in the lateral direction in the carriage 2. Thus, even if a transparent film is used as the atmospheric pressure detection film 7 located on the right side surface, the liquid supply units 3 other than the one in a rightmost part cannot allow the ink liquid level in the second chamber 42 to be seen. However, in this embodiment, the monitor pipe 36 stands in front of the liquid supply unit 3. Thus, the user can know the ink liquid level in each second chamber 42 by seeing the monitor pipe 36 of each liquid supply unit 3 from the front of the carriage 2.

The backflow prevention mechanism 38 is installed on the top wall 442 near the front end of the communication chamber 44. The top wall 442 is perforated with a supply hole 443 in correspondence with the backflow prevention mechanism 38. The upstream end 341 of the downstream pipe 34 is connected to the backflow prevention mechanism 38. The ink stored in the second chamber 42 is supplied to the downstream pipe 34 through the support hole 443 and the backflow prevention mechanism 38 by being sucked by the ink discharging portion 22. The backflow prevention mechanism 38 is described in detail later.

With reference to FIGS. 11A and 11B, an opening in a left surface side of the first chamber 41 is sealed by the sealing film 7A made of resin. The sealing film 7A has an outer shape matching a wall shape of the first partition wall 411 viewed from left. A peripheral edge part of the sealing film 7A is welded or adhered to an end surface of the first partition wall 411, whereby the sealing film 7A seals the opening of the first chamber 41.

An opening in a right surface side of the second chamber 42 is sealed by the atmospheric pressure detection film 7 made of a flexible resin film member. The atmospheric pressure detection film 7 has an outer shape matching a wall shape of an integral assembly of the second partition wall 421 of the second chamber 42 and the wall portion 441 of the communication chamber 44. Specifically, the atmospheric pressure detection film 7 includes a body portion 71 corresponding to the hollow cylindrical wall 422 of the second chamber 42, an upper extended portion 72 corresponding to the rectangular upper wall 423 and a lower extending portion 73 corresponding to the wall portion 441 of the communication chamber 44. The atmospheric pressure detection film 7 seals the openings of the second chamber 42 and the communication chamber 44 by welding or adhering a peripheral edge part of the body portion 71 to an end surface of the hollow cylindrical wall 422, a peripheral edge part of the upper extending portion 72 to an end surface of the upper wall 423 and a peripheral edge part of the lower extending portion 73 to an end surface of the wall portion 441. Note that the atmospheric pressure detection film 7 is welded or adhered without particular tension being applied thereto.

The pump portion 32 is arranged behind and adjacent to the tank portion 31 and includes a pump cavity 321 for housing the pump 9 and a cam shaft insertion hole 322 into which a cam shaft 93 (FIG. 4) for pivotally supporting an eccentric cam 91 (FIG. 24A) of the pump 9 is inserted. The pump cavity 321 is a hollow cylindrical cavity arranged at a center position of the pump portion housing 320 in the front-rear and vertical directions. The cam shaft insertion hole 322 is a boss hole provided at a position concentric with the pump cavity 321. An opening in a right surface side of the pump cavity 321 is sealed by a pump cover 323. As just described, in this embodiment, the pump cavity 321 is integrally provided to the tank portion base plate 310 serving as the base board of the tank portion 31, and the pump 9 for pressurized purging is mounted in the liquid supply unit 3 itself. In this way, the device configuration of the carriage 2 can be made compact and simple.

[Details of Negative Pressure Supply Mechanism]

Next, a negative pressure supply mechanism for supplying the ink from the first chamber 41 to the second chamber 42 as the ink in the second chamber 42 decreases is described in detail. The negative pressure supply mechanism includes the pressing member 5, the on-off valve 6 and the atmospheric pressure detection film 7 whose operations are summarily described above on the basis of FIG. 6 and further includes the biasing spring 45 (biasing member). The on-off valve 6 is arranged in the communication opening 43 and the posture thereof changes between the closing posture for closing the communication opening 43 and the opening posture for opening the communication opening 43. The biasing spring 45 biases the on-off valve 6 in a direction toward the closing posture. The pressing member 5 can press the on-off valve 6 in a direction toward the opening posture. The atmospheric pressure detection film 7 is displaced based on a negative pressure generated as the ink in the second chamber 42 decreases, and transmits that displacement force to the pressing member 5.

<Pressing Member>

Figure 12A:
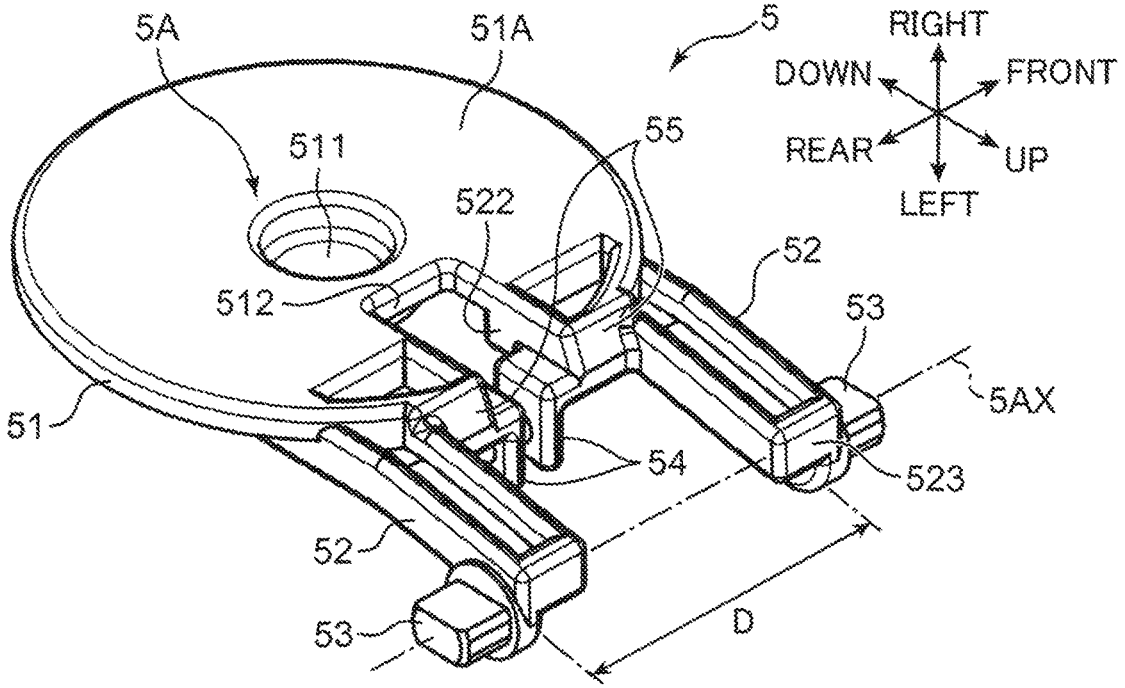
FIG. 12A is a perspective view of a pressing member and FIG. 12B is a perspective view of the pressing member obliquely viewed in a different direction.
Figure 12B:
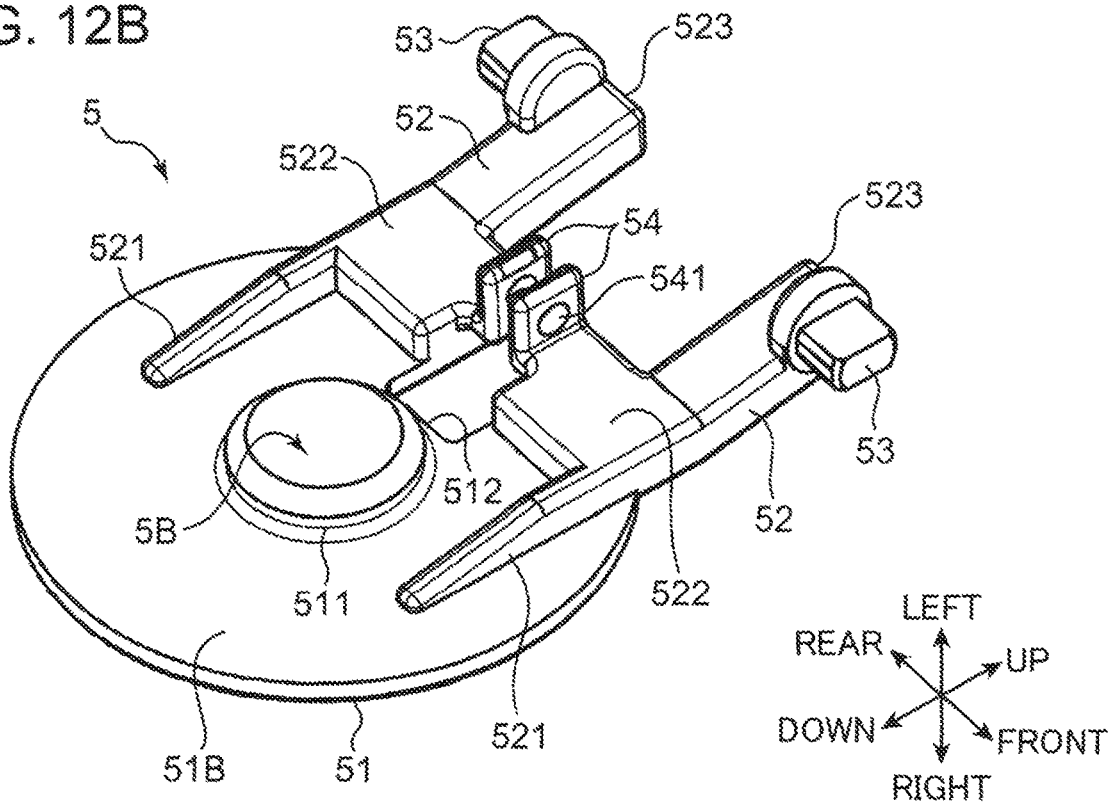

FIGS. 12A and 12B are perspective views of the pressing member 5 viewed in different directions. The pressing member 5 is a member rotatably arranged in the second chamber 42. The pressing member 5 includes a disk portion 51 (flat plate portion) formed of a circular flat plate, a pair of arm portions 52 extending outward from an upper end side (one end side) of the disk portion 51, pivot portions 53 (pivot point) provided on extending tip parts of the respective arm portions 52 and a pair of link bosses 54 (pressing portion). The pair of pivot portions 53 are pivotally supported by the pivotally supporting portions 426 (FIGS. 10 and 22) of the pair of supporting plates 425 arranged in the second chamber 42. In this way, the disk portion 51 is rotatable about an axis of the pivot portions 53.

The disk portion 51 is a disk having a diameter, which is about half the inner diameter of the hollow cylindrical wall 422 defining most of the second chamber 42. The hollow cylindrical wall 422 and the disk portion 51 in a state pivotally supported by the pivotally supporting portions 426 are substantially concentrically arranged. The disk portion 51 has a first surface 51A facing the atmospheric pressure detection film 7 and a second surface 51B facing the on-off valve 6. A spring fitting projection 511 is provided to project from the second surface 51B in a radial center of the disk portion 51. A right end part of the biasing spring 45 formed of a coil spring is fit into this spring fitting projection 511. Note that a region of the spring fitting projection 511 is formed into a cylindrical recess on the side of the first surface 51A.

The disk portion 51 includes a pressure receiving portion 5A for receiving a displacement force from the atmospheric pressure detection film 7 and a biased portion 5B for receiving a biasing force from the biasing spring 45. The pressure receiving portion 5A is a region (predetermined position of the first surface) of a peripheral edge part of the spring fitting projection 511 on the first surface 51A of the disk portion 51. The biased portion 5B is a region of the spring fitting projection 511, to which the biasing spring 45 is fit, on the side of the second surface 51B. Specifically, the biased portion 5B is set at a position corresponding to the pressure receiving portion 5A.

If the pressure receiving portion 5A receives no displacement force from the atmospheric pressure detection film 7, the disk portion 51 is in a state close to a naturally hanging state. However, the right end of the biasing spring 45 is in contact with the biased portion 5B and the first surface 51A is in contact with the inner surface of the atmospheric pressure detection film 7. On the other hand, if the pressure receiving portion 5A receives a displacement force equal to or larger than the biasing force of the biasing spring 45 from the atmospheric pressure detection film 7, the disk portion 51 rotates leftward about the axis of pivot portions 53 and is inclined leftward from the hanging state.

Lower end parts 521 of the pair of arm portions 52 are respectively located on both lateral parts of the spring fitting projection 511, whereby the spring fitting projection 511 is positioned to be sandwiched by a pair of the lower end parts 521. The pair of arm portions 52 extend straight upward from the respective lower end parts 521. A cutout portion 512 cut along a radial direction is provided in the disk portion 51 between the pair of arm portions 52. The pair of arm portions 52 extend in parallel from the disk portion 51 with this cutout portion 512 therebetween.

Rectangular thick portions 522 are provided at vertical intermediate positions of the respective arm portions 52. The thick portions 522 are arranged near the upper end of the disk portion 51 and lateral to the cutout portion 512. That is, a pair of the thick portions 522 face each other in the front-rear direction across the cutout portion 512. The pivot portion 53 projects in the front-rear direction from a tip part 523, which is an extending end of each arm portion 52. In particular, the pivot portions 53 project in directions separating from each other such that the pivot portion 53 projects forward from the front surface of the front tip part 523 and the pivot portion 53 projects rearward from the rear surface of the rear tip part 523. The pivot portions 53 are fit into the pivotally supporting portions 426 of the pivot portions 425. It contributes to increasing a leverage ratio to be described later to provide the pivot portions 53 on the extending tip parts of the arm portions 52.

The pair of pivot portions 53 are arranged on an axis of rotation 5AX extending in the front-rear direction. The front pivot portion 53 (one end on the axis of rotation) and the rear pivot portion 53 (other end on the axis of rotation) are arranged at a predetermined distance D from each other. That is, the pair of pivot portions 53 are arranged apart from each other across a part equivalent to a central region in a plane direction of the disk portion 51. The distance D can be set to about 40% to 80% of a diameter of the disk portion 51. In this way, pivot points formed by the pair of pivot portions 53 are pivot points spaced wide apart to sandwich the central region of the disk portion 51. Thus, the disk portion 51 rotating about the pivot points is less likely to be twisted about an axis perpendicular to the axis of rotation 5AX. Therefore, the rotating operation of the disk portion 51 can be stabilized.

The pair of link bosses 54 project leftward from the second surface 51B near the upper end of the disk portion 51. In particular, the link bosses 54 formed of rectangular flat plates respectively stand from end edges of the pair of thick portions 522 facing the cutout portion 512. Accordingly, the pair of link bosses 54 are located inwardly of the pair of pivot portions 53 in the central region of the disk portion 51. Each link boss 54 includes a link hole 541 (second link engaging portion). This link hole 541 is used to link and connect the pressing member 5 and the on-off valve 6. By this link connection, opening and closing operations of the on-off valve 6 are linked with the rotating operation of the pressing member 5.

In other words, the link bosses 54 serve as pressing portions for pressing and moving the on-off valve 6 in the lateral direction according to the rotating operation of the pressing member 5 rotating about the axis of the pivot portions 53. In a relationship of the pressure receiving portion 5A (point of force application) and the pivot portions 53 (fulcrum), the link bosses 54 (point of action) are set between the pressure receiving portion 5A and the pivot portions 53. That is, the pressure receiving portion 5A, the pivot portions 53 and the link bosses 54 are set to satisfy a positional relationship of a second class lever. Thus, a pressing force can be applied to the on-off valve 6 from the link bosses 54 by increasing the displacement force of the atmospheric pressure detection film 7 received by the pressure receiving portion 5A by the leverage ratio.

<On-Off Valve>

Next, the on-off valve 6 is described. As shown in FIGS. 11A and 11B, the on-off valve 6 is arranged in the communication opening 43 allowing communication between the first chamber 41 and the second chamber 42. The on-off valve 6 opens and closes the communication opening 43 by moving in the lateral direction in the communication opening 43, following the rotating operation of the pressing member 5. The on-off valve 6 is link-connected to the link bosses 54 (pressing portions) of the disk portion 51 to follow the above rotating operation.

Figure 13A:
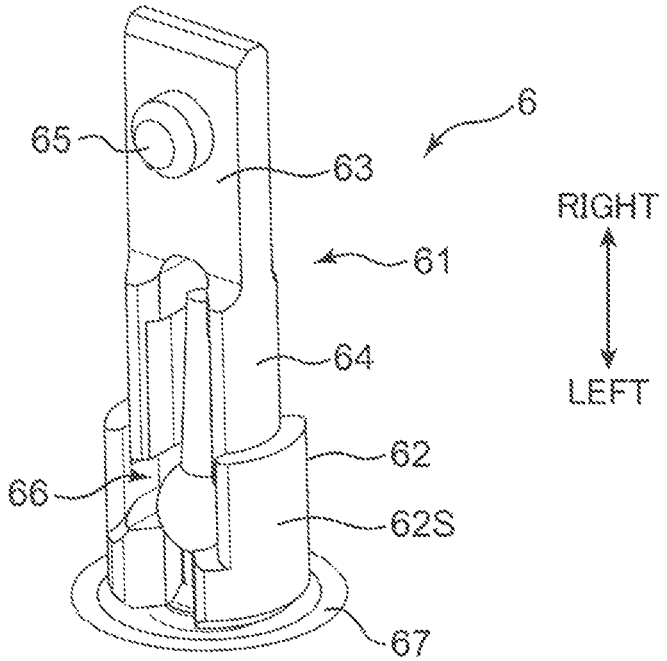
FIG. 13A is a perspective view of an on-off valve and FIG. 13B is an exploded perspective view of the on-off valve.
Figure 13B:
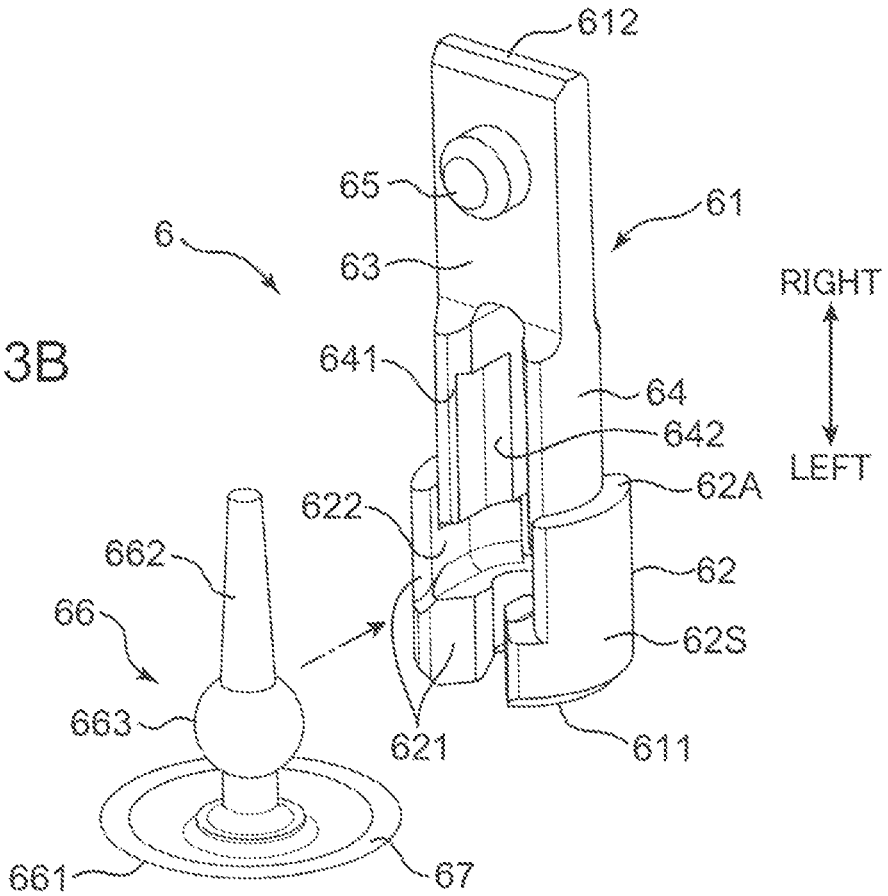
Figure 14A:
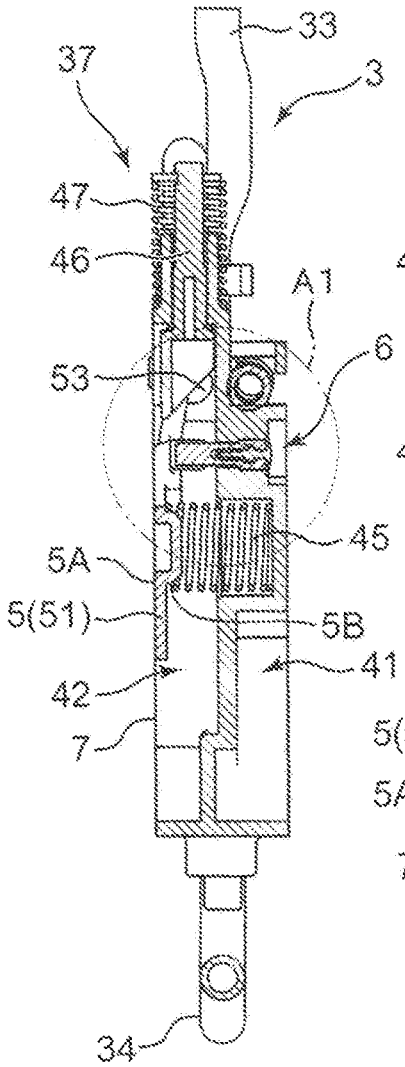
FIG. 14A is a sectional view along line XIV-XIV of FIG. 8 showing a state where the on-off valve is in a closing posture and FIG. 14B is an enlarged view of a part A1 of FIG. 14A.
Figure 14B:
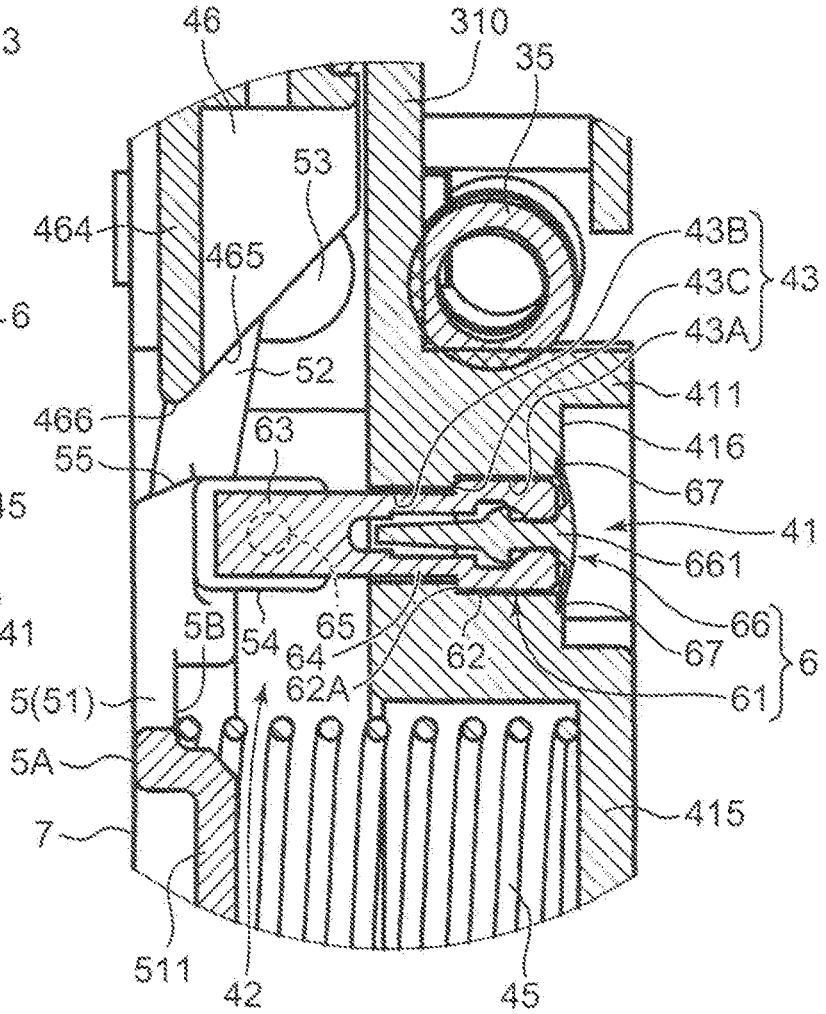
Figure 14B:
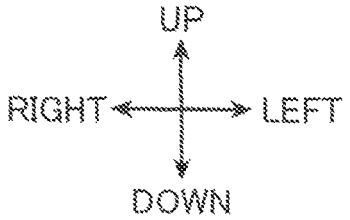
Figure 15A:
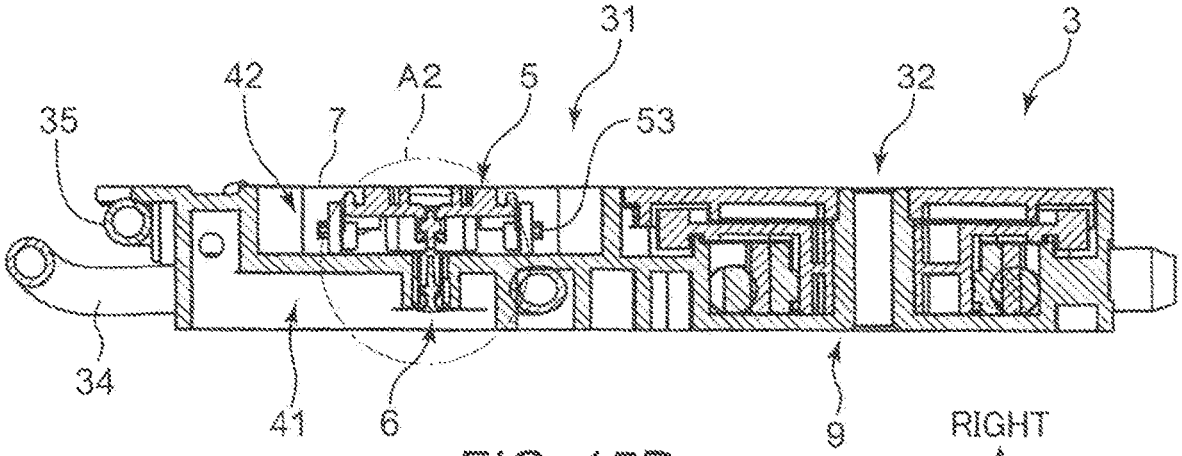
FIG. 15A is a sectional view along line XV-XV of FIG. 8 showing the state where the on-off valve is in the closing posture and FIG. 15B is an enlarged view of a part A2 of FIG. 15A.
Figure 15B:
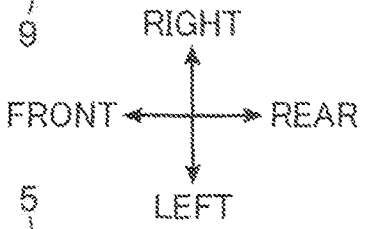
Figure 15B:
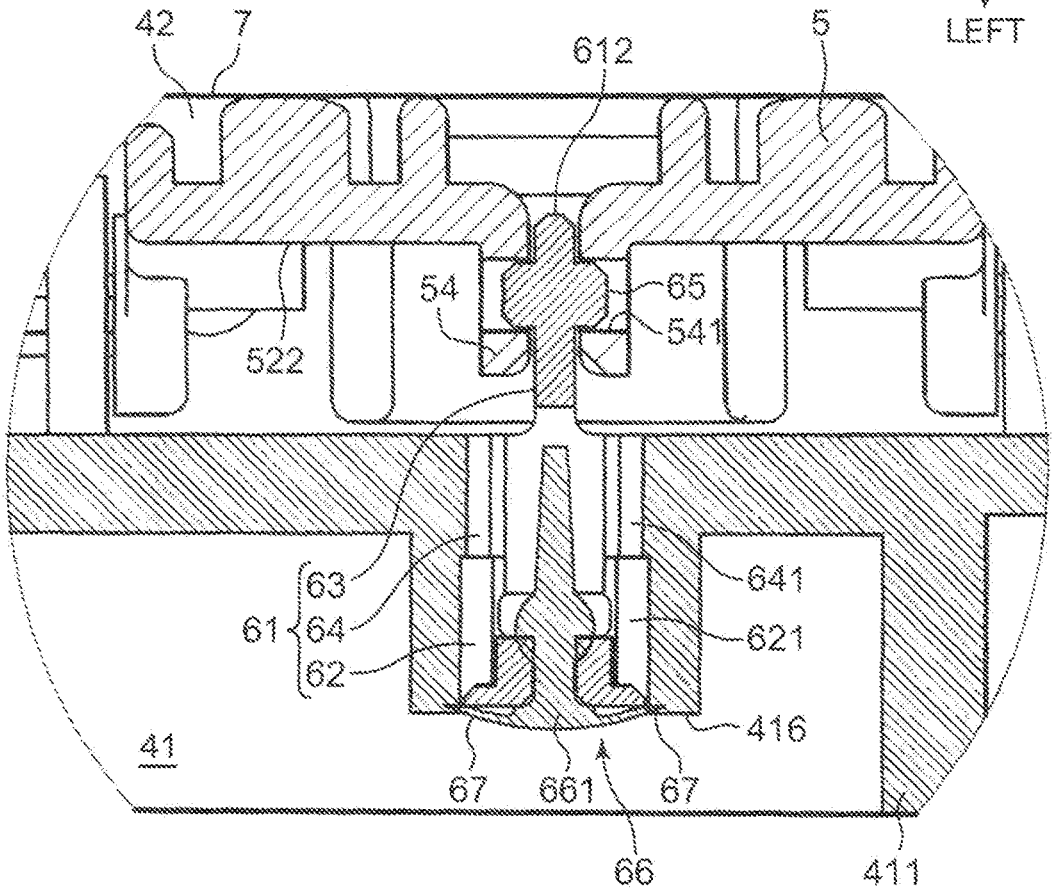

FIG. 13A is a perspective view of the on-off valve 6 and FIG. 13B is an exploded perspective view of the on-off valve 6. FIG. 14A is a sectional view along line XIV-XIV of FIG. 8 and FIG. 14B is an enlarged view of a part A1 of FIG. 14A. FIG. 15A is a sectional view along line XV-XV of FIG. 8 and FIG. 15B is an enlarged view of a part A2 of FIG. 15A. The on-off valve 6 is an assembly of a valve holder 61 and an umbrella valve 66 (valve member) held by the valve holder 61. The communication opening 43 is an opening having a circular cross-sectional shape and includes a large-diameter portion 43A, a small-diameter portion 43B having a smaller inner diameter than the large-diameter portion 43A and a step portion 43C based on a diameter difference between the both.

The valve holder 61 is a semi-cylindrical member including a first end part 611 located on the side of the first chamber 41 (left side) and a second end part 612 located on the side of the second chamber 42 (right side) in a state mounted in the communication opening 43. The valve holder 61 includes a tube portion 62 on the side of the first end part 611, a flat plate portion 63 on the side of the second end part 612, an intermediate portion 64 located between the tube portion 62 and the flat plate portion 63, and link pins 65 (first link engaging portion) disposed on the flat plate portion 63. The umbrella valve 66 is held on the side of the first end part 611 of the valve holder 61.

The tube portion 62 is a tubular part having a largest outer diameter in the valve holder 61. The tube portion 62 includes a guide surface 62S, which is the outer peripheral surface of the tube portion 62, a flow passage cutout 621 formed by cutting a part of the tube portion 62 in a circumferential direction, and a holding groove 622 annularly recessed on an inner peripheral side of the tube portion 62. The tube portion 62 is housed into the large-diameter portion 43A of the communication opening 43, and the guide surface 62S is guided by the inner surface of the large-diameter portion 43A when the on-off valve 6 moves in the lateral direction. The flow passage cutout 621 serves as a flow passage in which the ink flows when the on-off valve 6 is in the opening posture. The holding groove 622 is a groove for holding a locking spherical portion 663 of the umbrella valve 66.

The intermediate portion 64 is a tubular part having a smaller outer diameter than the tube portion 62. The intermediate portion 64 includes an open portion 641, which is an open part connected to the flow passage cutout 621, and a pin housing portion 642 for housing a pin portion 662 of the umbrella valve 66. The intermediate portion 64 is housed in the small-diameter portion 43B of the communication opening 43 and the outer peripheral surface thereof is also guided by the inner surface of the small-diameter portion 43B. On a boundary part between the tube portion 62 and the intermediate portion 64, an annular contact portion 62A formed by a step based on an outer diameter difference between the both is present. The annular contact portion 62A faces and comes into contact with the step portion 43C of the communication opening 43.

The flat plate portion 63 is a part projecting rightward from the communication opening 43 with the on-off valve 6 mounted in the communication opening 43. The flat plate portion 63 has a pair of front and back flat surfaces extending in the lateral direction. The link pin 65 projects in the vertical direction from each of the pair of flat surfaces. These link pins 65 are fit into the link holes 541 provided in the link bosses 54 of the pressing member 5 as shown in FIG. 15B. By this fitting, the pressing member 5 and the on-off valve 6 can be link-connected and translate a rotational motion of the pressing member 5 into a linear motion of the on-off valve 6.

The umbrella valve 66 is an article made of rubber and includes an umbrella portion 661, the pin portion 662 extending rightward from the umbrella portion 661 and the locking spherical portion 663 integrally provided to the pin portion 662. The umbrella portion 661 has an umbrella diameter larger than an inner diameter of the large-diameter portion 43A of the communication opening 43. A peripheral edge part on an inner side (right surface side) of the umbrella portion 661 is a sealing surface 67. The sealing surface 67 can seal the communication opening 43 by coming into contact with a sealing wall surface 416, which is a wall surface around the communication opening 43 (closing posture). On the other hand, if the sealing surface 67 is separated from the sealing wall surface 416, the sealed state is released (opening posture). Note that the umbrella shape of the umbrella portion 661 is inverted (FIGS. 26A and 26B) if a predetermined pressure is applied to the right surface side of the umbrella portion 661.

The pin portion 662 is a rod-like part extending in the lateral direction and serving as a support column for the umbrella portion 661. The pin portion 662 is inserted into the tube portion 62 of the valve holder 61 and the pin housing portion 642 of the intermediate portion 64. That is, the umbrella portion 661 can come into contact with the first end part 661 of the valve holder 61, whereas the pin portion 662 can be fit into an inner tube portion of the valve holder 61. The locking spherical portion 663 is a part formed by spherically bulging a part of the pin portion 662 near a left end and to be fit into the holding groove 622. By fitting the locking spherical portion 663 into the holding groove 622, the umbrella valve 66 is held in the valve holder 61 with lateral movements restricted. Specifically, the umbrella valve 66 moves in the lateral direction integrally with the valve holder 61.

<Biasing Spring>

The biasing spring 45 is a coil spring interposed between the second surface 51B of the disk portion 51 and the tank portion base plate 310 and supporting (biasing) the second surface 51B. In particular, as shown in FIG. 14B, a right end side of the biasing spring 45 is fit to the spring fitting projection 511 of the disk portion 51, and a left end side thereof is housed in the spring seat 415 recessed in the tank portion base plate 310. When the pressure receiving portion 5A of the disk portion 51 receives a leftward displacement force acting against a rightward biasing force of the biasing spring 45, the disk portion 51 rotates leftward about the axis of the pivot portions 53. Unless receiving the above displacement force, the disk portion 51 is maintained in a hanging posture by the biasing force.

<Operation of On-Off Valve>

Next, the opening and closing operations of the on-off valve 6 are described. FIGS. 14A to 15B show a state where the on-off valve 6 is in the closing posture. This state is a state where the atmospheric pressure detection film 7 is not generating such a displacement force as to rotate the pressing member 5 (disk portion 51), i.e. a state where the sum of a spring pressure (biasing force) of the biasing spring 45 and an inner pressure of the second chamber 42 is larger than the atmospheric pressure. Although the second chamber 42 is set to the negative pressure, the biasing spring 45 biases the biased portion 5B of the disk portion 51 by a biasing force exceeding a displacement force of the atmospheric pressure detection film 7 caused by the negative pressure. Thus, the disk portion 51 does not rotate about the axis of the pivot portions 53 and is maintained in the aforementioned hanging posture.

In this case, the on-off valve 6 link-connected to the pressing member 5 by the link bosses 54 is in the closing posture located on a rightmost side. Specifically, the valve holder 61 is pulled rightward via the link bosses 54 by the biasing force of the biasing spring 45. Thus, the annular contact portion 62A of the valve holder 61 butts against the step portion 43C of the communication opening 43 and the sealing surface 67 of the umbrella valve 66 comes into contact with the sealing wall surface 416. Therefore, the communication opening 43 is sealed by the umbrella valve 66. The biasing spring 45 can be said to bias the on-off valve 6 in the direction toward the closing posture, utilizing a lever force, by biasing the disk portion 51 rightward.

Figure 16A:
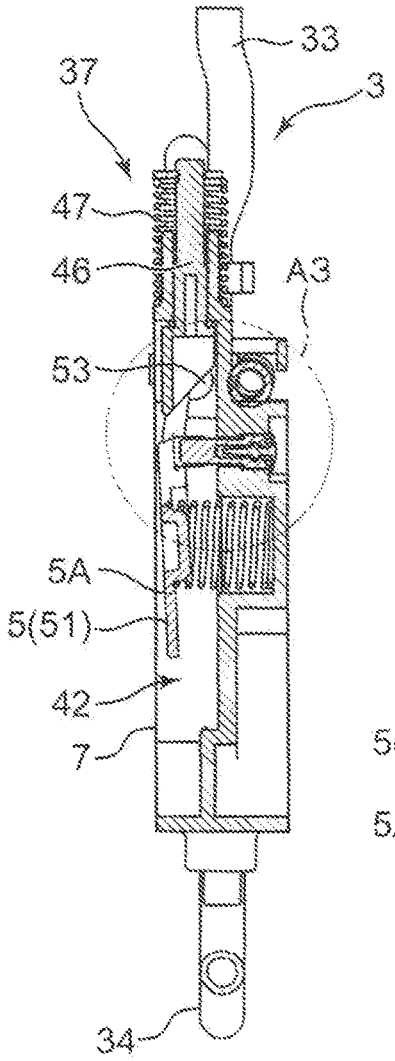
FIG. 16A is a sectional view, corresponding to FIG. 14A, showing a state where the on-off valve is in an opening posture
Figure 16B:
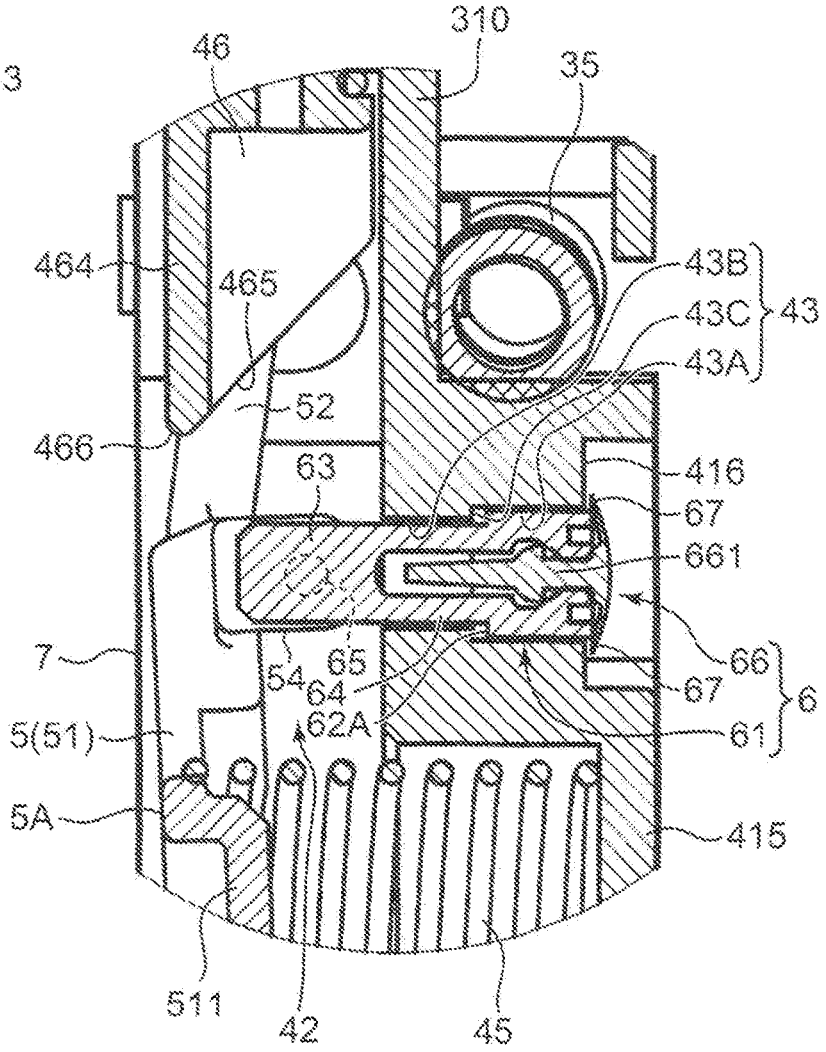
FIG. 16B is an enlarged view of a part A3 of FIG. 16A.
Figure 16B:
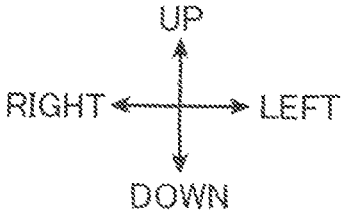
Figure 17:
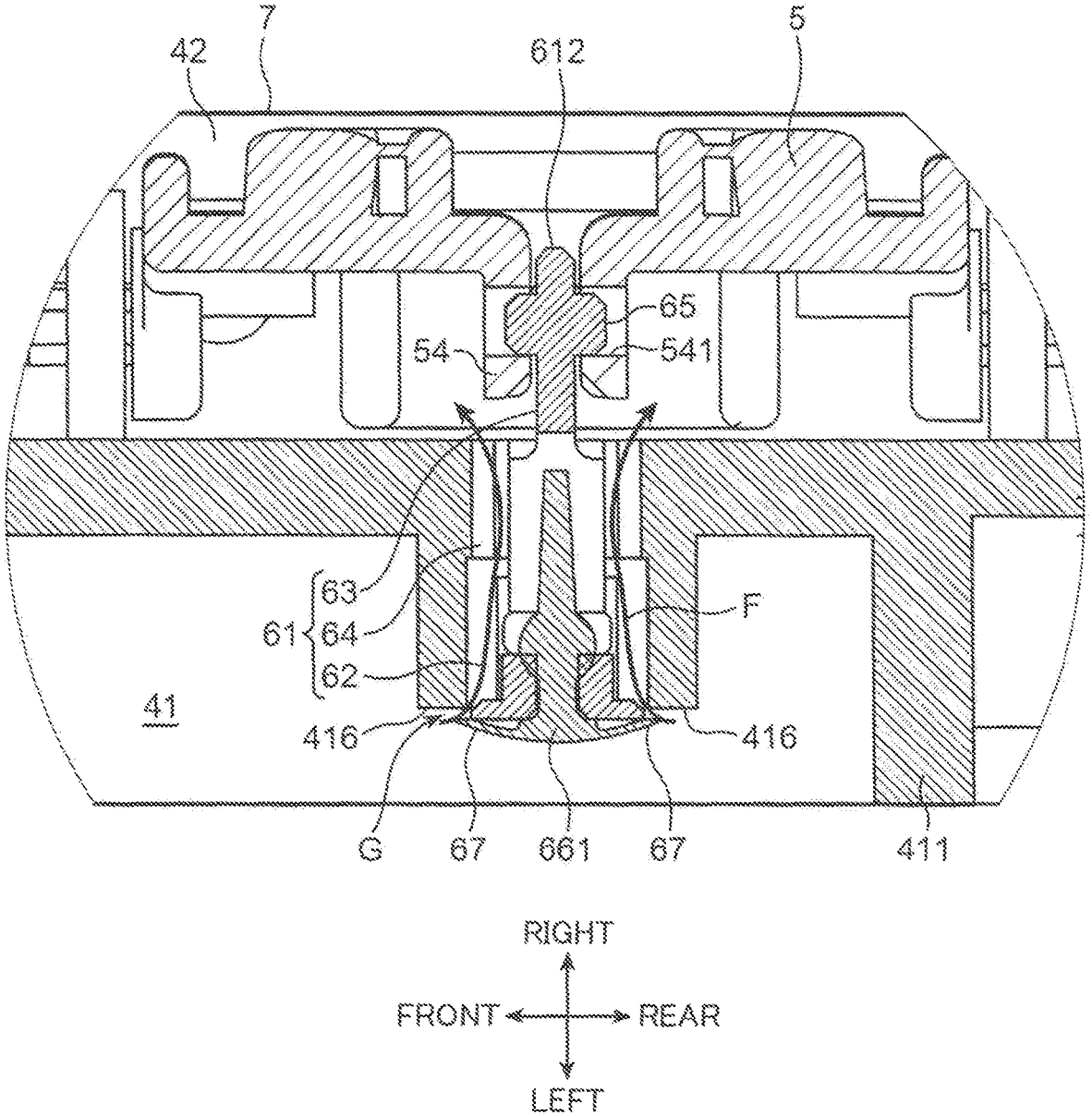
FIG. 17 is a sectional view, corresponding to FIG. 15B, showing the state where the on-off valve is in the opening posture.

FIG. 16A is a sectional view, corresponding to FIG. 14A, showing the state where the on-off valve 6 is in the opening posture and FIG. 16B is an enlarged view of a part A3 of FIG. 16A. FIG. 17 is a sectional view, corresponding to FIG. 15B, showing the state where the on-off valve is in the opening posture. As the ink discharging portion 22 continues the operation of discharging ink droplets from the state of FIGS. 14 to 15B, the negative pressure degree of the second chamber 42, which is a sealed space, gradually increases as the ink decreases. Eventually, when the second chamber 42 reaches a negative pressure exceeding the predetermined threshold value, the atmospheric pressure detection film 7 applies a pressing force acting against the biasing force of the biasing spring 45 to the pressure receiving portion 5A of the disk portion 51. Specifically, a state is entered where the sum of the spring pressure of the biasing spring 45 and the inner pressure of the second chamber 42 is less than the atmospheric pressure.

In this case, the disk portion 51 rotates leftward about the axis of the pivot portions 53 against the biasing force of the biasing spring 45. By this rotation, the link bosses 54 generate a pressing force to move the on-off valve 6 leftward and changes the posture of the on-off valve 6 to the opening posture. That is, the pressing force is transmitted from the link holes 541 of the link bosses 54 to the link pins 65 of the valve holder 61, and the valve holder 61 linearly moves leftward while the guide surface 62S is guided by the inner surface of the communication opening 43. According to this movement, the umbrella valve 66 also moves leftward and the sealing surface 67 thereof is separated from the sealing wall surface 416 to form a gap G. Thus, the sealing of the communication opening 43 by the umbrella valve 66 is released.

When the on-off valve 6 reaches the opening posture, the ink flows from the first chamber 41 into the second chamber 42 due to a pressure difference between the first chamber 41 set to the pressure, which is the sum of the atmospheric pressure and ρgh, and the second chamber 42 with a progressed negative pressure degree as indicated by an arrow F in FIG. 17. Specifically, the ink flows into the second chamber 42 through a flow passage composed of the gap G between the sealing surface 67 of the umbrella valve 66 and the sealing wall surface 416, the flow passage cutout 621 prepared in the tube portion 62 of the valve holder 61 and the open portion 641 prepared in the intermediate portion 64.

As the ink flows into the second chamber 42, the negative pressure degree of the second chamber 42 is gradually alleviated. Eventually, when the sum of the spring pressure of the biasing spring 45 and the inner pressure of the second chamber 42 becomes more than the atmospheric pressure, the disk portion 51 is pushed back rightward by the biasing force of the biasing spring 45. Specifically, when the second chamber 42 reaches a negative pressure below the predetermined threshold value, the disk portion 51 rotates rightward about the axis of the pivot portions 53 by being pressed by the biasing force of the biasing spring 45. In this way, the on-off valve 6 also linearly moves rightward by being pulled by the link bosses 54. At some stage, the annular contact portion 62A of the valve holder 61 butts against the step portion 43C of the communication opening 43 and the sealing surface 67 of the umbrella valve 66 comes into contact with the sealing wall surface 416. Thus, the on-off valve 6 returns to the closing posture.

<Functions and Effects of Negative Pressure Supply Mechanism>

Figure 18A:
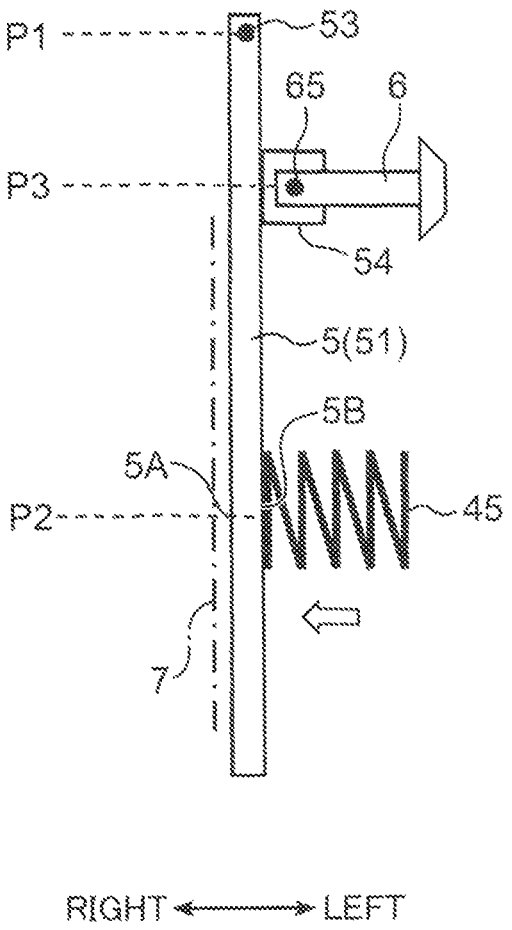
FIGS. 18A and 18B are diagrams showing the operation of the pressing member utilizing a leverage ratio.
Figure 18B:
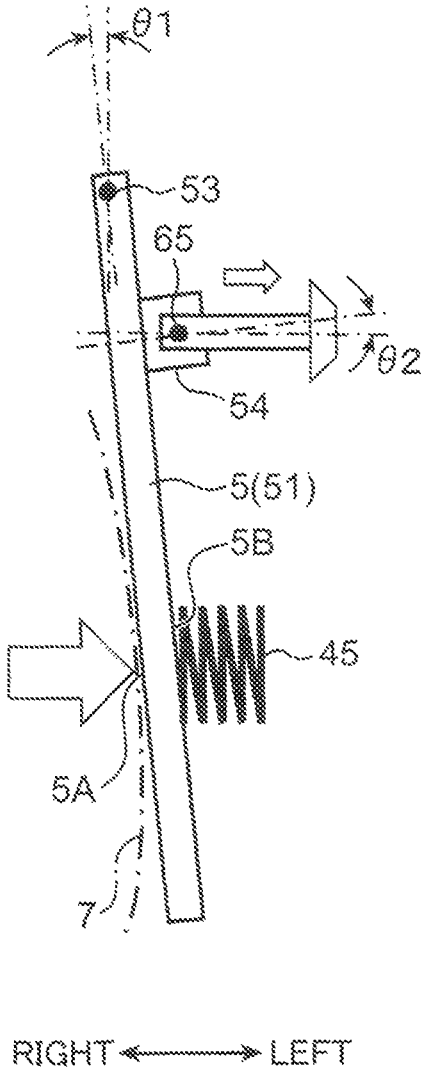

Functions and effects of the negative pressure supply mechanism of this embodiment having the above configuration are described using diagrams of FIGS. 18A and 18B. FIG. 18A shows a state where the pressing member 5 (disk portion 51) is in the hanging posture and the on-off valve 6 is in the closing posture, and FIG. 18B shows a state where the pressing member 5 is rotated to reach an oblique posture and the on-off valve 6 is in the opening posture.

First, the pressing member 5 has pivot points, which are the pivot portions 53, and are pivotally supported by the supporting plates 425 disposed in the second chamber 42. Thus, if the pressure receiving portion 5A receives a displacement force of the atmospheric pressure detection film 7, the pressing member 5 rotates about the axis of the pivot portions 53. That is, an unstable moving force, which is a displacement of the atmospheric pressure detection film 7, can be translated into a stable moving force, which is rotation about the axis of the pivot portions 53. Thus, the displacement force of the atmospheric pressure detection film 7 can be efficiently transmitted to the on-off valve 6 through the link bosses 54 (pressing portions). For example, if a pressing member for the on-off valve 6 does not have any pivot point, such as by being attached to the atmospheric pressure detection film 7, such a behavior becomes unstable and a pressing force is unstably transmitted to the on-off valve 6. However, since the pressing member 5 can generate a stable pressing force according to this embodiment, the posture of the on-off valve 6 can be changed between the closing posture and the opening posture at a desired timing and the ink can be stably supplied to the head unit 21.

Further, the pressing member 5 can cause the link bosses 54 to generate a large pressing force, utilizing a lever force. Specifically, the link bosses 54 for pressing the on-off valve 6 are arranged between the pressure receiving portion 5A and the pivot portions 53. That is, the pressing member 5 realizes a pressing structure for the on-off valve 6 utilizing the principle of leverage with the pivot points by the pivot portions 53 serving as a fulcrum P1, the pressure receiving portion 5A serving as a point of force application P2 and the link bosses 54 serving as a point of action P3. Accordingly, a pressing force applied to the pressure receiving portion 5A by a displacement force of the atmospheric pressure detection film 7 can be applied from the link bosses 54 to the on-off valve 6 while being increased by the leverage ratio. Thus, the link bosses 54 can be caused to press the on-off valve 6 by a large pressing force and a sufficient pressing force for timely moving the on-off valve 6 can be ensured.

The pressing member 5 includes the arm portions 52 extending upward from the upper end side of the disk portion 51, and the pivot portions 53 serving as the pivot points are provided on the extending tip parts 523 of the arm portions 52. This configuration contributes to extending a distance between the pressure receiving portion 5A (point of force application P2) and the link bosses 54 (point of action P3) and increasing the leverage ratio. Thus, the pressing force generated by the pressing member 5 can be made even larger.

Further, an advantage brought by the link connection of the on-off valve 6 to the pressing member 5 can be cited as an advantage of another perspective. In particular, the link connection is formed by the link pins 65 disposed near the right end (second end part 612) of the on-off valve 6 and the link holes 541 of the link bosses 54. The biasing spring 45 biases the on-off valve 6 in the direction toward the closing posture by pressing the biased portion 5B of the disk portion 51. Thus, the disk portion 51 rotates about the axis of the pivot portions 53 to be inclined, but the on-off valve 6 can be prevented from being inclined, following the inclining movement of the disk portion 51, by the link connection. Therefore, the on-off valve 6 can be linearly moved in the lateral direction in the communication opening 43 and the on-off valve 6 can be stably operated between the closing posture and the opening posture.

Here, a biasing member equivalent to the biasing spring 45 may be structured to bias the on-off valve 6 directly rightward (direction toward the closing posture) as a modification. However, in this embodiment, the biasing spring 45 presses the disk portion 51 and indirectly biases the on-off valve 6 in the direction toward the closing posture. Thus, a degree of freedom of the biasing structure for the on-off valve 6 can be enhanced as compared to the case where the biasing structure is provided near the communication opening 43. Further, the biased portion 5B for receiving the biasing force from the biasing spring 45 is set at the position corresponding to the pressure receiving portion 5A. Thus, an efficient biasing structure is realized, utilizing the principle of leverage, also in biasing the on-off valve 6 via the disk portion 51 by the biasing spring 45.

[Air Vent Mechanism of Second Chamber]

Figure 19A:
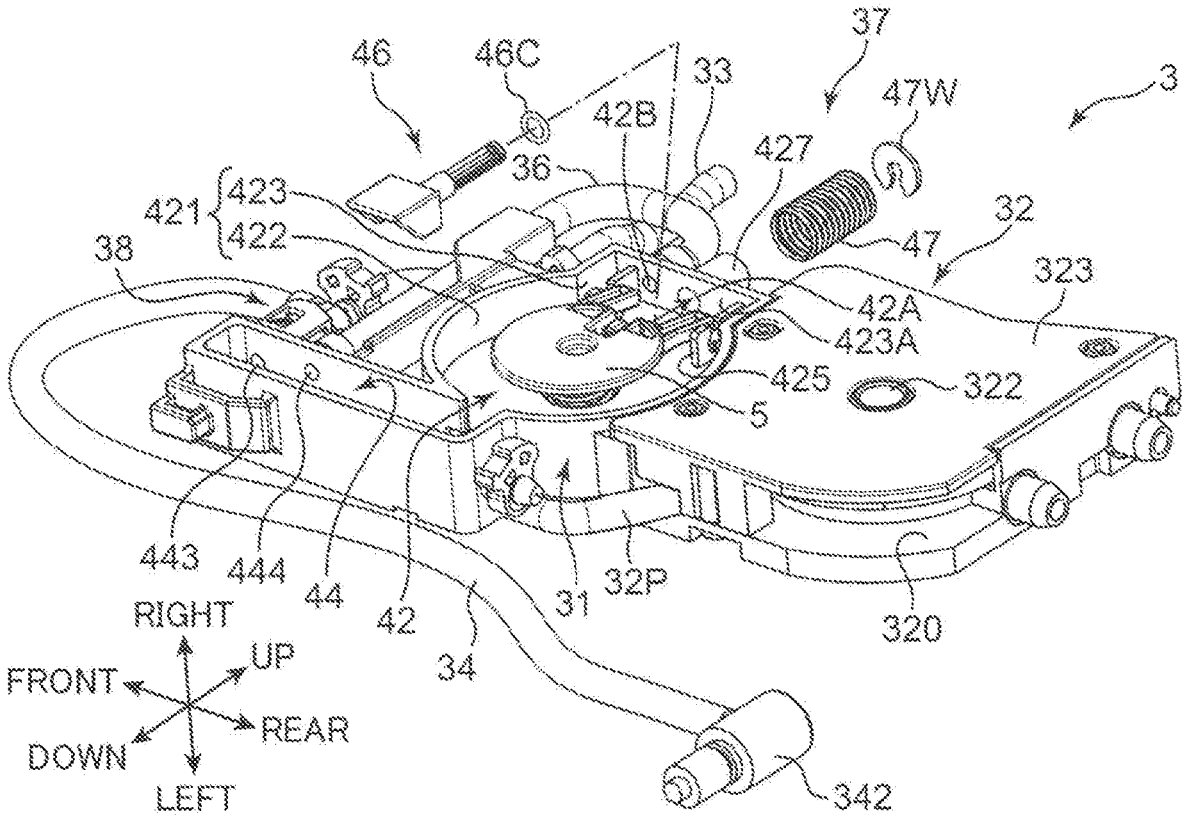
FIG. 19A is an exploded perspective view of an air vent mechanism of the liquid supply unit and FIGS. 19B and 19C are perspective views of a lever member.
Figure 19B:
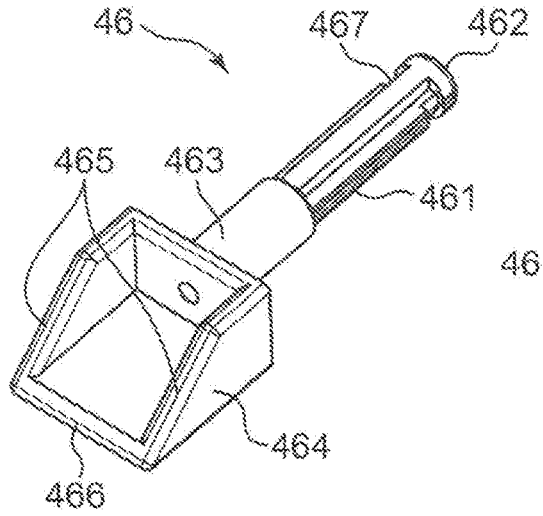
Figure 19C:
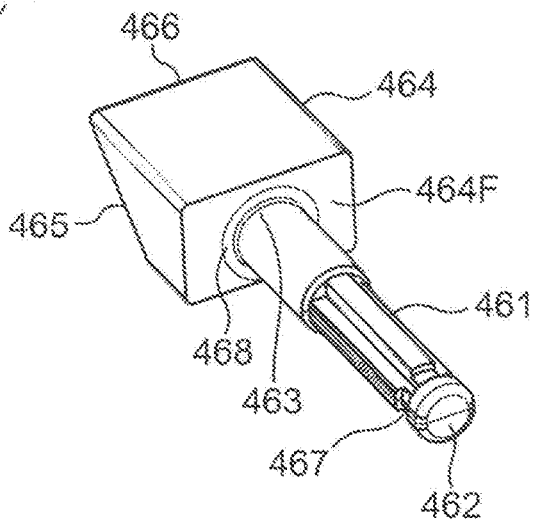

Next, the air vent mechanism 37 attached to the second chamber 42 is described in detail. FIG. 19A is an exploded perspective view of the liquid supply unit 3 including the air vent mechanism 37 and FIGS. 19B and 19C are perspective views of the lever member 46. As described above, the air vent mechanism 37 is used in venting air and deaerating air bubbles generated from the ink when the ink is initially filled into the second chamber 42 during initial usage, after maintenance and the like.

The air vent mechanism 37 includes the lever member 46, a sealing ring 46C and the return spring 47 in addition to the aforementioned boss portion 427 projecting on the second partition wall 421 defining the second chamber 42. The boss portion 427 projects on the top wall 423A defining the top surface of the second chamber 42 and includes an opening allowing the second chamber 42 to communicate with the atmosphere, i.e. the boss hole 42A serving as an air vent hole. The second chamber 42 can be reliably deaerated by providing the boss hole 42A in the top wall 423A located at the uppermost position of the second chamber 42.

The lever member 46 includes a rod-like member 461 to be partially inserted into the boss hole 42A and a pressing piece 464 connected below the rod-like member 361, and has a shovel-like shape. The lever member 46 is one type of a valve member whose posture is changed between a sealing posture for sealing the boss hole 42A and an opening posture for opening the boss hole 42A. In this embodiment, a posture changing operation of the lever member 46 is linked with that of the on-off valve 6 via the pressing member 5. Specifically, the on-off valve 6 is allowed to be in the closing posture when the lever member 46 is in the sealing posture, and the posture of the on-off valve 6 is changed from the closing posture to the opening posture when the lever member 46 is in the opening posture.

The rod-like member 461 of the lever member 46 is a cylindrical body having an outer diameter smaller than a hole diameter of the boss hole 42A and includes an upper end part 462 and a lower end part 463. The upper end part 462 serves as an input portion for receiving an operational pressing force for pressing the lever member 46 downward from a user. The lower end part 463 is linked to the pressing piece 464. The pressing piece 464 functions as a transmitting portion for transmitting the operational pressing force applied to the upper end part 462 to the pressing member 5 (receiving slopes 55).

The upper surface of the pressing piece 464 to which the lower end part 463 of the rod-like member 462 is linked is a flange surface 464F larger than the hole diameter of the boss hole 42A. The flange surface 464F is a rectangular plane perpendicular to an axis of the rod-like member 461 and, with the rod-like member 461 inserted in the boss hole 42A, faces the inner surface of the top wall 423A. The pressing piece 464 is shaped to be trapezoidal when viewed in the front-rear direction and substantially square when viewed in the lateral direction, and includes a pair of pressing slopes 465 inclined with respect to the axis of the rod-like member 461 and a lower end edge 466 extending in the front-rear direction on the lowermost end. The pair of pressing slopes 465 are respectively slopes (oblique sides) extending upward with end parts of the lower end edge 466 in the front-rear direction as starting points.

The pressing slopes 465 and the lower end edge 466 interfere with the pressing member 5 when the lever member 46 receives the operational pressing force. With reference to FIGS. 12A and 12B, the pressing member 5 is provided with a pair of receiving slopes 55 on the first surface 51A on a side below the pivot portions 53 and facing the atmospheric pressure detection film 7. The receiving slopes 55 are arranged between the link bosses 54 and the arm portions 52 on the upper end of the disk portion 51. An interval between the pair of receiving slopes 55 is set to match an interval between the pair of pressing slopes 465. The pressing slopes 465 and the lower end edge 466 come into contact with the receiving slopes 55 and transmit the operational pressing force to the pressing member 5 when the user applies the operational pressing force. In this way, the pressing member 5 rotates leftward about the axis of the pivot portions 53 to change the posture of the on-off valve 6 from the closing posture to the opening posture.

An engaging groove 467 is formed near the upper end part 462 of the rod-like member 461. A washer 47W for locking the upper end of the return spring 47 is fit into the engaging groove 467. The flange surface 464F of the pressing piece 464 is formed with a sealing groove 468 into which the sealing ring 46C is fit. The return spring 47 is a coil spring having an inner diameter larger than the outer diameter of the boss portion 427 and a spring length longer than a vertical length of the boss portion 427, and is externally fit to the boss portion 427. The sealing ring 46C is an O-ring having an inner diameter somewhat larger than the rod-like member 461. The sealing ring 46C is fit from the upper end part 462 of the rod-like member 461 and mounted into the sealing groove 468. Note that the sealing groove 468 may be omitted.

Figure 20A:
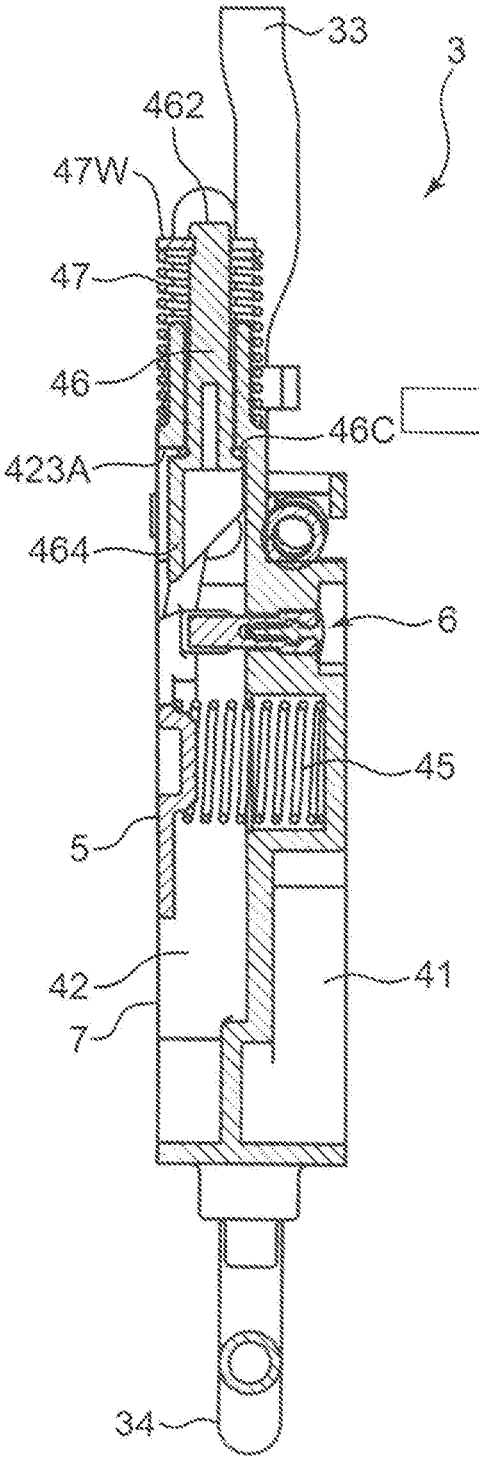
FIG. 20A is a sectional view showing a state before the lever member is operated and FIG. 20B is a sectional view showing a state where air is vented by the operation of the lever member.
Figure 20B:
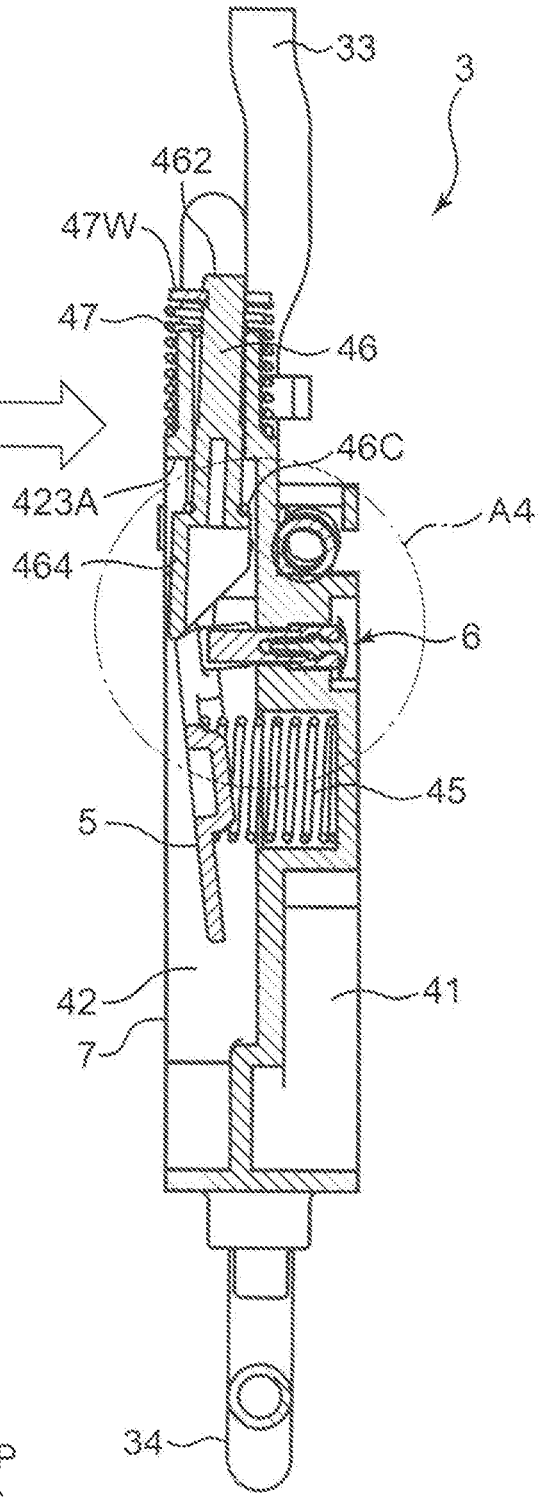
Figure 20B:
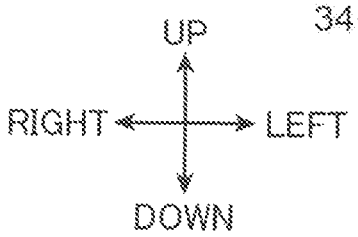
Figure 21:
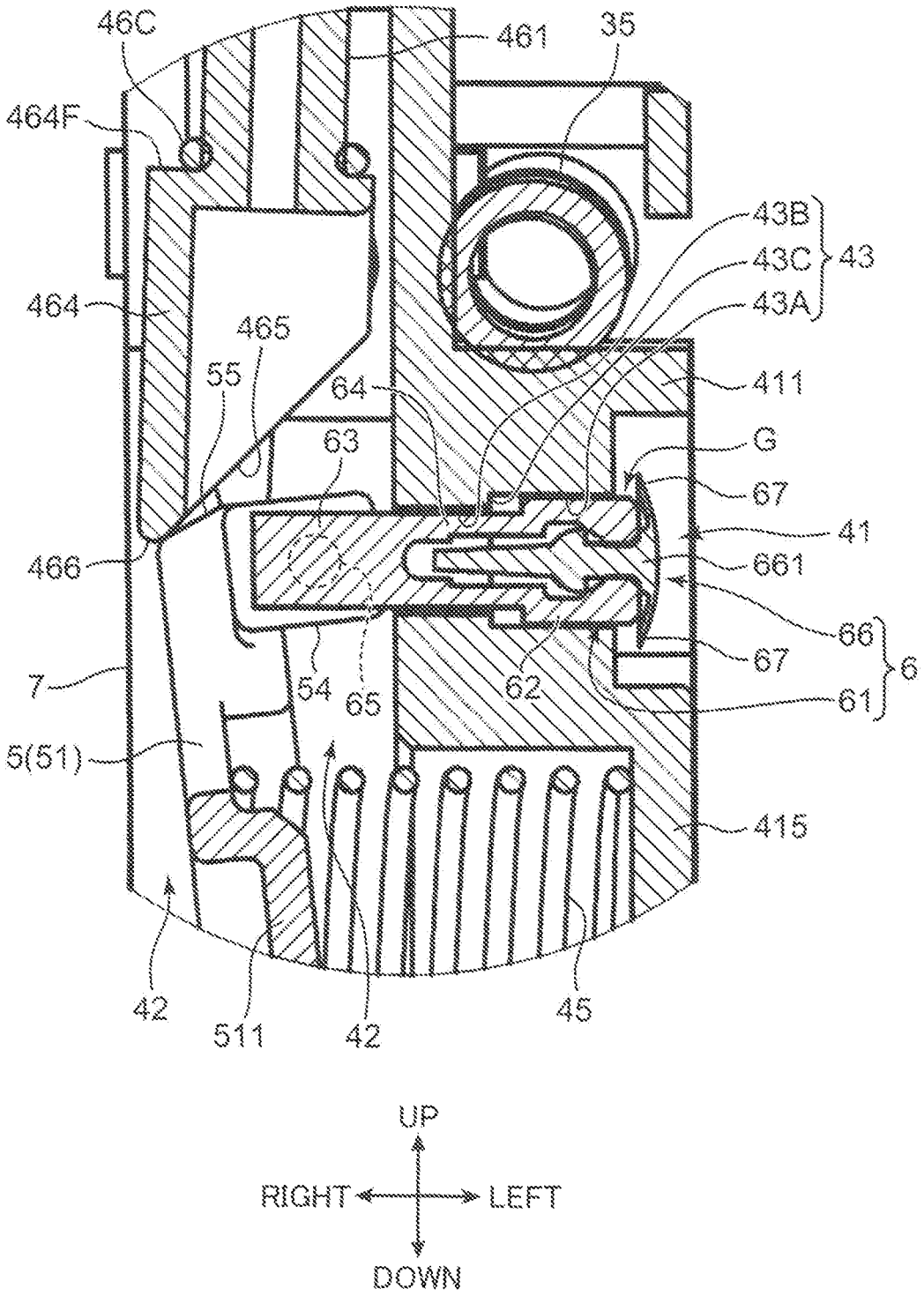
FIG. 21 is an enlarged view of a part A4 of FIG. 20B.

Next, the operation of the lever member 46 is described. FIGS. 20A and 20B are sectional views respectively showing a state before the lever member 46 is operated and a state where air is vented by the operation of the lever member 46. FIG. 21 is an enlarged view of a part A4 of FIG. 20B. FIG. 20A shows a state where the upper end part 462 of the lever member 46 is not pressed down, i.e. the sealing posture in which the lever member 46 seals the boss hole 42A. On the other hand, FIG. 20B shows a state where the upper end part 462 is pressed downward to apply an operational pressing force, i.e. the opening posture in which the lever member 46 opens the boss hole 42A.

The sealing posture is maintained by a biasing force of the return spring 47. The return spring 47 generates a force for lifting the lever member 46 upward via the washer 47W. That is, the return spring 47 biases the lever member 46 toward the sealing posture. In this way, the sealing ring 46C held on the flange surface 464F comes into contact with the top wall 423A on the peripheral edge of the boss hole 42A. Accordingly, the boss hole 42A is sealed. A state at this time is the same as the previously mentioned state shown in FIGS. 14A and 14B. The pressing piece 464 (pressing slopes 465 and lower end edge 466) of the lever member 46 is separated from the receiving slopes 55 of the pressing member 5 and applies no force to the pressing member 5. Thus, the on-off valve 6 is maintained in the closing posture.

On the other hand, if the lever member 46 receives an operational pressing force to be lowered and assume the opening posture, the flange surface 464F is also lowered and, accordingly, the sealing ring 46C is separated from the top wall 423A. Thus, the boss hole 42A is opened. Specifically, the second chamber 42 and outside air communicate through a clearance between the inner surface of the boss hole 42A and the outer peripheral surface of the rod-like member 461. Thus, a state is set in which air staying in the second chamber 42 can be exhausted to outside through the boss hole 42A.

Further, if the lever member 46 assumes the opening posture, the operational pressing force is transmitted to the pressing member 5. As shown in FIG. 21, the pressing slopes 465 and the lower end edge 466 press the receiving slopes 55. The receiving slopes 55 are located below the pivot portions 53 and shifted toward right (toward the atmospheric pressure detection film 7). Thus, if the receiving slopes 55 are pressed, the pressing member 5 (disk portion 51) rotates leftward about the axis of the pivot portions 53. As described above, if the pressing member 5 rotates leftward, the on-off valve 6 is pressed leftward via the link bosses 54 and the posture of the on-off valve 6 is changed from the closing posture to the opening posture. In this way, the sealing of the communication opening 43 is released and the first and second chambers 41, 42 communicate.

As just described, if the lever member 46 assumes the opening posture, an inlet (communication opening 43) for fluid into the second chamber 42 and an outlet (boss hole 42A) for fluid are ensured. Thus, during initial usage, the operation of filling the ink from the first chamber 41 into the second chamber 42 through the communication opening 43 while air in the second chamber 42 is vented through the boss hole 42A can be smoothly performed, utilizing the supply by the water head difference. Further, if the amount of air in the second chamber 42 increases (confirmed by the monitor pipe 36 since the ink liquid level in the second chamber 42 drops) such as due to the generation of air bubbles from the ink, air can be easily vented from the second chamber 42 by setting the lever member 46 to the opening posture.

In the above embodiment, the posture of the on-off valve 6 is changed to the opening posture in conjunction with the lever member 46 assuming the opening posture, utilizing the pressing member 5 including the pressure receiving portion 5A for receiving a displacement force from the atmospheric pressure detection film 7 and the link bosses 54 for pressing the on-off valve 6 by the displacement force received by the pressure receiving portion 5A. That is, the inlet and outlet for fluid into and from the second chamber 42 can be ensured in a single operation of the lever member 46. Accordingly, the user can easily perform the operation of venting air in the second chamber 42. Further, since the air vent mechanism 37 is arranged on the upper surface of the tank portion 31, the user can perform the air venting operation for each liquid supply unit 3 by accessing from the front of the carriage 2 even with the plurality of liquid supply units 3 mounted in the carriage 2 as shown in FIG. 4.

[Backflow Prevention Mechanism]

Figure 23C:
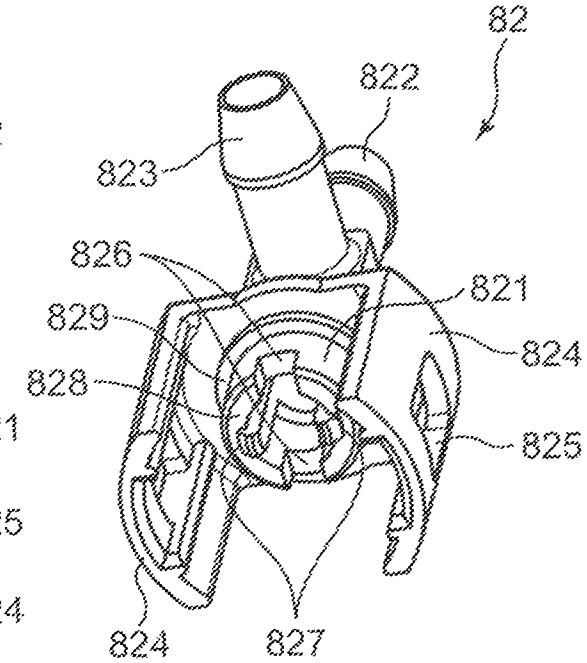
FIG. 23B is a view showing a state where the spherical body closes the valve conduit and FIG. 23C is a perspective view of a branched head portion.
Figure 23B:
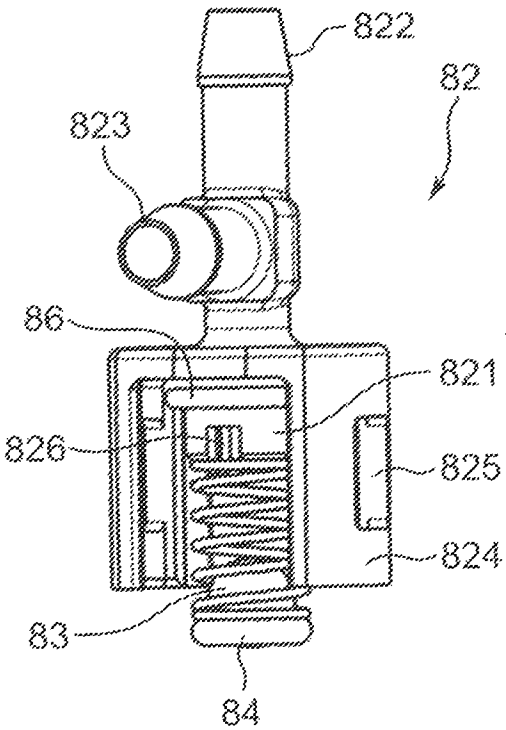
Figure 23A:
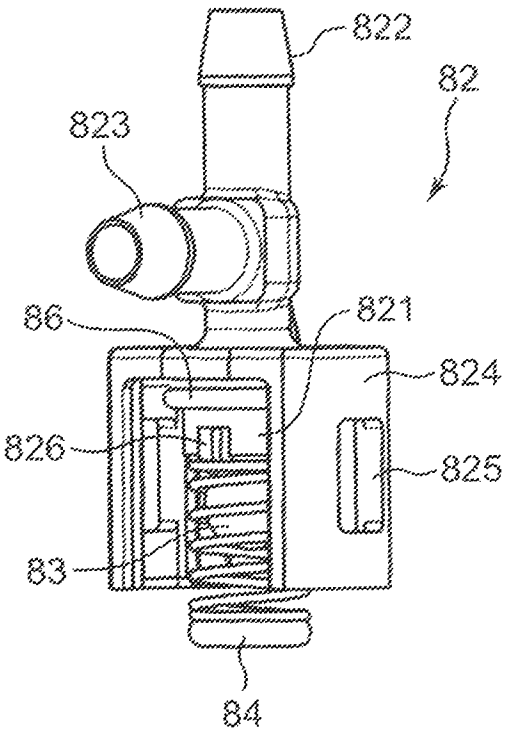
FIG. 23A is a perspective view of the backflow prevention mechanism showing a state where a spherical body opens a valve conduit.

Next, the configuration of the backflow prevention mechanism 38 for preventing the pressurized ink from flowing back to the second chamber 42 when the pressurized purge mode described on the basis of FIG. 7A is performed is described. FIG. 22 is a perspective view of the base board 300 of the liquid supply unit 3 including an exploded perspective view of the backflow prevention mechanism 38. The backflow prevention mechanism 38 includes a valve conduit 81, a branched head portion 82, a spherical body 83, a sealing member 84, a coil spring 85 and an O-ring 86. The valve conduit 81 is a member integral with the top wall 442 of the communication chamber 44 and the other components are mounted into the valve conduit 81. FIGS. 23A and 23B are perspective views of the backflow prevention mechanism 38 excluding the valve conduit 81, and FIG. 23C is a perspective view of the branched head portion 82 viewed from below.

The valve conduit 81 is a conduit extending in the vertical direction from the upper surface of the top wall 442. The valve conduit 81 provides an ink flow passage linking the communication chamber 44 and the downstream pipe 34 and constitutes a part of an ink supply passage from the second chamber 42 to the ink discharging portion 22. A locking piece 811 projects on the outer peripheral surface of the valve conduit 81 and a fitting annular projection 812 projects on the inner peripheral surface of the valve conduit 81 to lock the branched head portion 82.

The branched head portion 82 is a member for forming the joint part a described above on the basis of FIGS. 6 to 7B. The branched head portion 82 includes a first inlet port 821, a second inlet port 822, an outlet port 823, trunk portions 824, a locking window 825, a cutout portion 826 and fitting claws 827. The first inlet port 821 is a port connected to the downstream end of the second chamber 42 and, in this embodiment, communicates with the second chamber 42 via the valve conduit 81 and the communication chamber 44. The second inlet port 822 is a port connected to the downstream end of the bypass pipe 35. The outlet port 823 is a port connected to the upstream end 341 of the downstream pipe 34. In the aforementioned print mode, the ink is supplied to the downstream pipe 34 through the first inlet port 821. On the other hand, in the pressurized purge mode, the ink is supplied to the downstream pipe 34 through the second inlet port 822.

The trunk portions 824 are composed of a pair of arcuate pieces arranged to face each other outside the first inlet port 821 facing downward. The valve conduit 81 enters a clearance between a pair of the trunk portions 824 and the first inlet port 821. The locking window 825 is an opening which is provided in the pair of trunk portions 824 and with which the locking piece 811 of the valve conduit 81 is engaged. The cutout portion 826 is a part formed by partially cutting a peripheral wall of the tubular first inlet port 821 and a part for securing the ink flow passage. The fitting claws 827 are hook-shaped parts projecting downward from the lower end of the first inlet port 821, and engage the fitting annular projection 812 of the valve conduit 81. That is, the branched head portion 82 is fixed to the valve conduit 81 by the engagement of the locking piece 811 and the locking window 825 on the inner periphery of the valve conduit 81 and by the engagement of the fitting annular projection 812 and the fitting claws 827 on the outer periphery of the valve conduit 81.

The spherical body 83 is housed into the valve conduit 81 movably in the ink supply direction and works as a valve. An outer diameter of the spherical body 83 is smaller than an inner diameter of the valve conduit 81 and smaller than an inner diameter of the coil spring 85. Various materials can be used as a material for forming the spherical body 83, but the spherical body 83 is preferably formed of a material having a specific weight equal to or less than twice the specific weight of the ink. The spherical body 83 is immersed in the ink in the valve conduit 81. By approximating the specific weight of the spherical body 83 to that of the ink, an operating pressure of the spherical body 83 in the ink supply direction (vertical direction here) can be made smaller.

Generally, ink used in an ink jet printer is water-soluble solution and has a specific weight equal to or near 1. Thus, it is desirable to select a material having a specific weight less than 2 as the material of the spherical body 83. Further, the above material desirably has properties such as chemical resistance and wear resistance not to be deteriorated even if the material is constantly in contact with the ink. From these perspectives, it is particularly preferable to use polyacetal resin (specific weight≈1.5) as the material of the spherical body 83.

The sealing member 84 is a sealing component having a ring shape and to be seated on a seat portion 813 below the spherical body 83 and on a bottom wall of the valve conduit 81 (upper surface of the top wall 442), for example, as shown in FIG. 24B. A ring inner diameter (through hole) of the sealing member 84 is set smaller than the outer diameter of the spherical body 83, but larger than the supply hole 443 perforated in the top wall 442. When the spherical body 83 is separated from this sealing member 84 as shown in FIG. 23A, the valve conduit 81 is opened. On the other hand, when the spherical body 83 contacts the sealing member 84 as shown in FIG. 23B, the valve conduit 81 is closed.

The coil spring 85 is a compression spring mounted in the valve conduit 81 such that a lower end part thereof comes into contact with the sealing member 84 and an upper end part thereof comes into contact with a lower end edge 828 of the first inlet port 821 of the branched head portion 82. The coil spring 85 biases the sealing member 84 toward the seat portion 813, whereby the sealing member 84 is constantly pressed into contact with the seat portion 813. Further, the spherical body 83 is housed inside the coil spring 85 and the coil spring 85 also functions to guide a movement of the spherical body 83 in the ink supply direction. Thus, a loose movement of the spherical body 83 in the valve conduit 81 can be restricted and a valve structure realized by movements of the spherical body 83 toward and away from the sealing member 84 can be stabilized.

The O-ring 86 seals butting parts of the valve conduit 81 and the branched head portion 82. The O-ring 86 is fit on the outer peripheral surface of the first inlet port 821 and in contact with a projecting base portion 829 of the first inlet port 821.

Figure 24A:
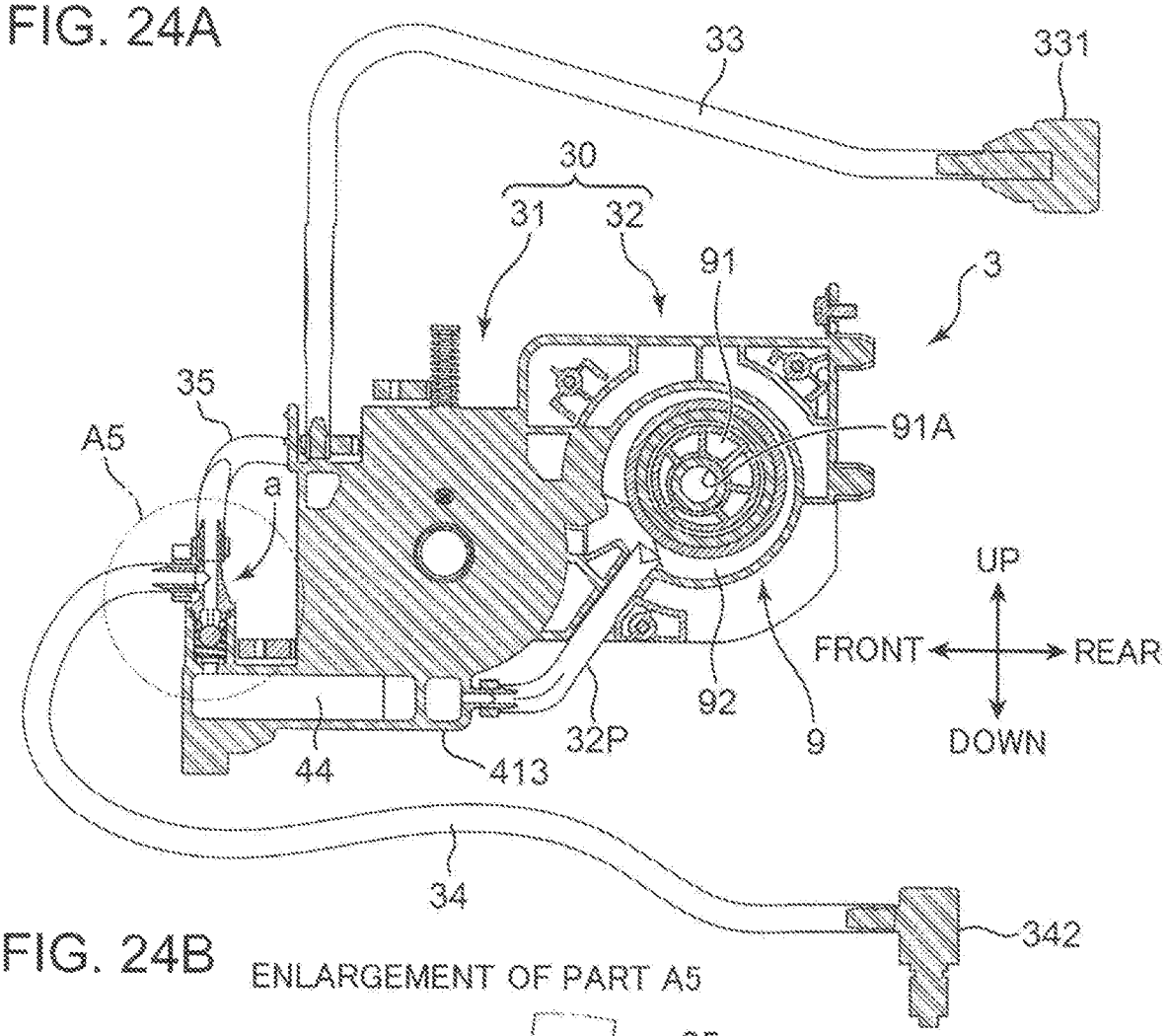
Figure 24A:
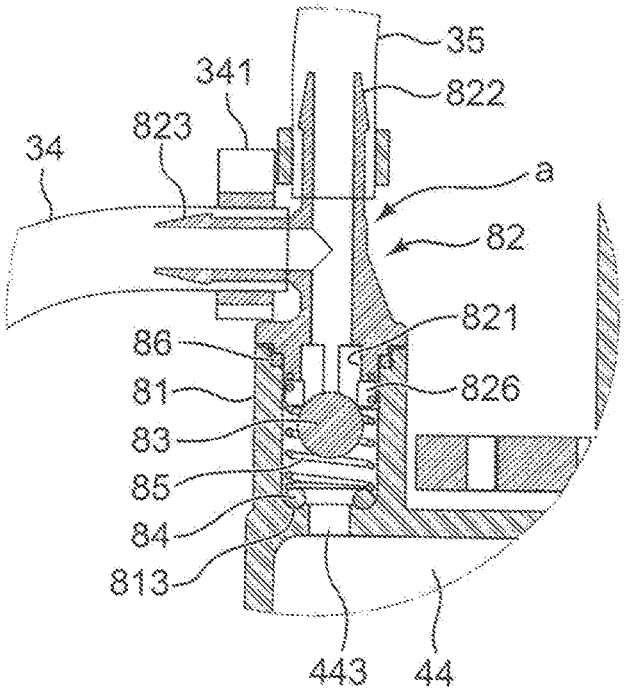

FIG. 24A is a sectional view showing a state of the backflow prevention mechanism 38 in the print mode, and FIG. 24B is an enlarged view of a part A5 of FIG. 24A. FIG. 24A shows the pump 9 housed in the pump portion 32. The pump 9 is a tube pump including the eccentric cam 91 and a squeeze tube 92. The cam shaft 93 (FIG. 4) serving as an axis of rotation of the eccentric cam 91 is inserted into a shaft hole 91A of the eccentric cam 91. A rotational drive force is applied to this eccentric cam 91 from an unillustrated drive gear. The squeeze tube 92 is arranged on the peripheral surface of the eccentric cam 91 and squeezed by the rotation of the eccentric cam 91 around the cam shaft 93 to feed the liquid (ink) in the tube from one end side toward the other end side. In this embodiment, the squeeze tube 92 is a tube integral with the communication pipe 32P and the bypass pipe 35. Specifically, one end side of the squeeze tube 92 communicates with the bottom wall portion 413 of the first chamber 41 (communication pipe 32P), the other end side communicates with the second inlet port 822 of the branched head portion 82 (bypass pipe 35) and a central part serves as a squeezing portion arranged on the peripheral surface of the eccentric cam 91.

As described above, the pump 9 is stopped in the print mode shown in FIG. 6. In this case, the eccentric cam 91 is stopped by squeezing the squeeze tube 92, wherefore the ink supply passage passing through the bypass pipe 35 is closed. On the other hand, the pump 9 is driven in the forward rotation direction in the pressurized purge mode shown in FIG. 7A. In FIG. 24A, the forward rotation direction of the eccentric cam 91 is a counterclockwise direction. By this forward drive of the pump 9, the ink is sucked from the first chamber 41 through the communication pipe 32P and flows toward the backflow prevention mechanism 38, which is the joint part a, from the bypass pipe 35. Note that when the pump 9 is driven in the reverse rotation direction, the communication chamber 44, the second chamber 42 and the downstream pipe 34 are set to the negative pressure through the bypass pipe 35 and the branched head portion 82 as shown in FIG. 7B.

Next, the operation of the backflow prevention mechanism 38 is described. In the print mode, the ink is supplied to the head unit 21 along a supply route passing through the communication chamber 44, the backflow prevention mechanism 38 and the downstream pipe 34 from the second chamber 42. In such a print mode, the spherical body 83 is separated from the sealing member 84 and lifted upward as shown in FIG. 24B. This relies on the fact that the supply route from the second chamber 42 to the downstream pipe 34 is maintained at the negative pressure in the print mode. Coupled with the suction of the ink present in the supply route by the ink discharging portion 22 of the head unit 21 every time ink droplets are discharged, a force acts on the spherical body 83 in the ink supply direction and the spherical body 83 is lifted from the sealing member 84 in the liquid ink.

Since the spherical body 83 is separated from the sealing member 84, the supply hole 443 of the communication chamber 44 is opened. On the other hand, the spherical body 83 may be lifted to contact the lower end edge 828 of the first inlet port 821 by a suction force of the ink discharging portion 22. FIG. 23A shows a state where the spherical body 83 is lifted to an uppermost position. Even in such a state, since the cutout portion 826 is provided in the peripheral wall of the first inlet port 821, a passage for the ink is ensured. Thus, the ink can pass from the communication chamber 44 to the branched head portion 82.

Figure 25A:
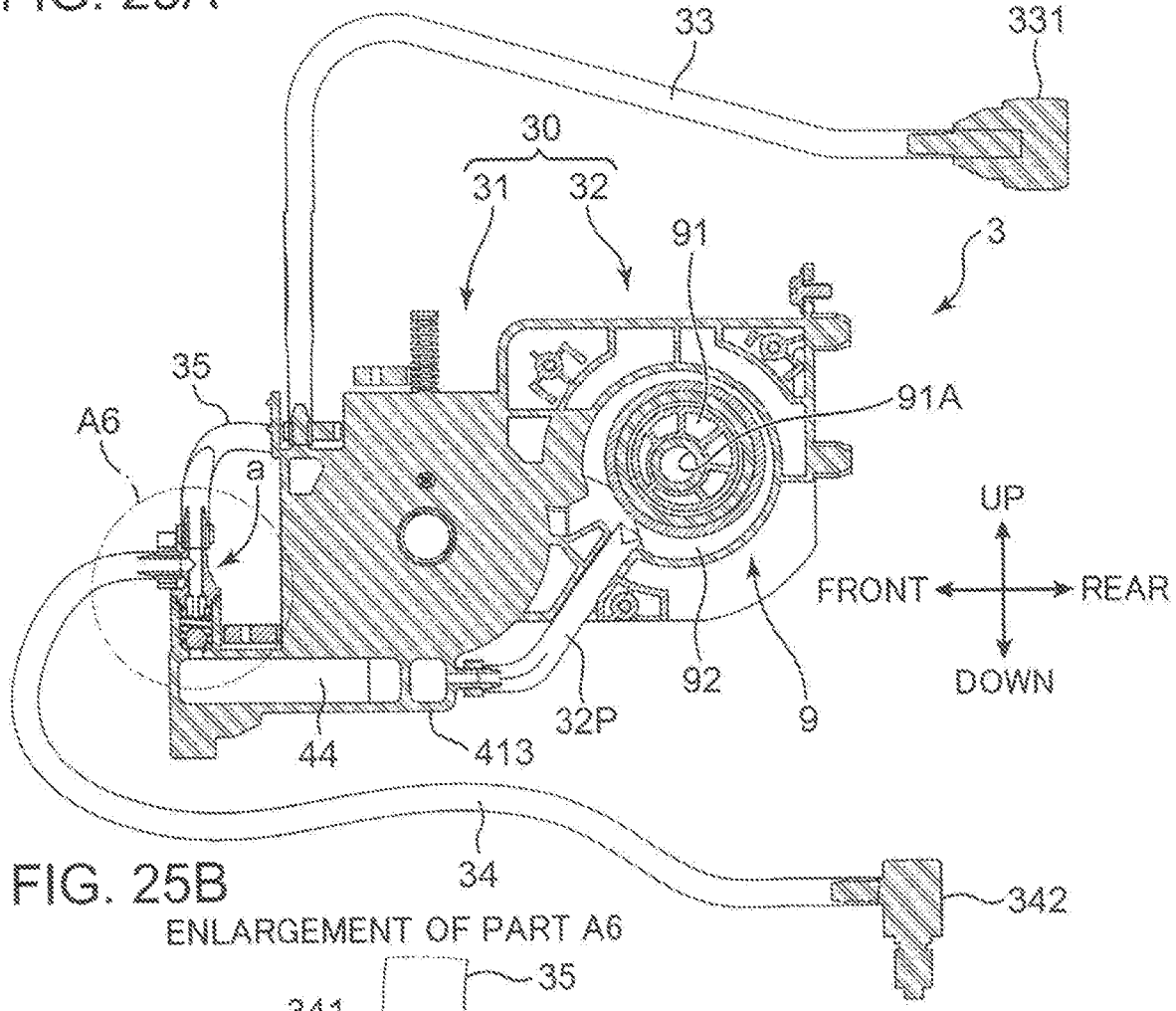
FIG. 25A is a sectional view showing a state of the backflow prevention mechanism in a pressurized purge mode and FIG. 25B is an enlarged view of a part A6 of FIG. 25A.
Figure 25B:
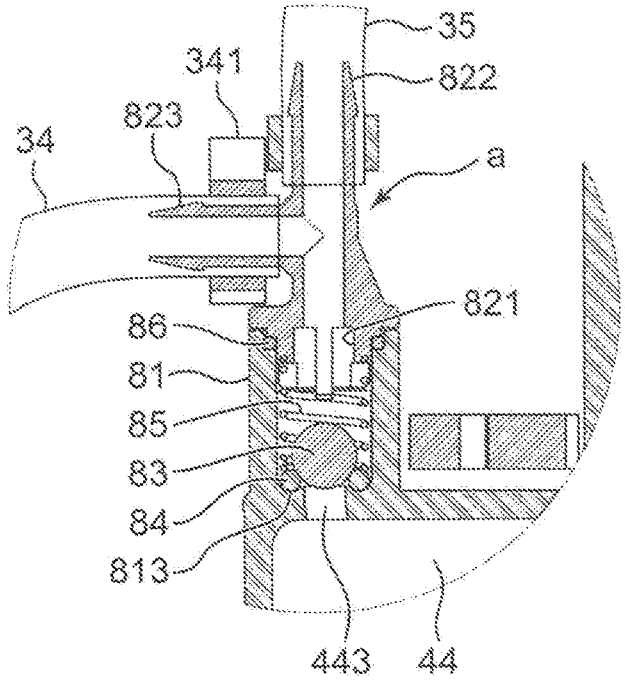

FIG. 25A is a sectional view showing a state of the backflow prevention mechanism 38 in the pressurized purge mode and FIG. 25B is an enlarged view of a part A6 of FIG. 25A. In the pressurized purge mode, the ink pressurized through the bypass pipe 35 is supplied to the second inlet port 822 (joint part a) of the branched head portion 82 by the forward drive of the pump 9. Thus, the bypass pipe 35 and the downstream pipe 34 located downstream of the joint part a are pressurized by the pressurized ink. In this case, the ink is pressurized to a high pressure exceeding 100 kPa. If such a high pressure is applied to the second chamber 42, the atmospheric pressure detection film 7 defining a part of the second chamber 42 may be broken or a part thereof attached to the second partition wall 421 may be peeled off However, in this embodiment, the spherical body 83 is pressed downward (upstream side in the ink supply direction) to contact the sealing member 84 by a pressurizing force applied to the joint part a. FIGS. 23B and 25B show a state where the spherical body 83 is fit into the ring-shaped sealing member 84 by being pressed. By the contact of the spherical body 83 with the sealing member 84 pressed against the seat portion 813 by the coil spring 85, the supply hole 443 is closed. Specifically, out of the ink supply path in the print mode, the communication chamber 44 and the second chamber 42 located upstream of the joint part a are blocked from pressurization by the pressurized ink. Thus, the breakage of the atmospheric pressure detection film 7 and the like can be prevented.

[Double Protection Mechanism by Umbrella Valve]

As described above, in this embodiment, a backflow of the ink pressurized in the pressurized purge mode to the second chamber 42 is prevented by providing the backflow prevention mechanism 38. However, the pressurizing force may possibly act on the second chamber 42 due to a certain trouble of the backflow prevention mechanism 38 such as an operation failure of the spherical body 83. In view of this point, a double protection mechanism for releasing the pressure to the on-off valve 6 is provided in this embodiment. That is, the on-off valve 6 has a pressure release mechanism for releasing the pressure from the second chamber 42 to the first chamber 41 if a pressure relationship that the second chamber 42 is set at a negative pressure and the first chamber 41 is set at the atmospheric pressure+ρgh at normal time is reversed and the second chamber 42 is set at a pressure higher than in the first chamber 41.

The umbrella valve 66 of the on-off valve 6 functions as the above pressure release mechanism. As described on the basis of FIGS. 14A to 17, the umbrella valve 66 seals the communication opening 43 by the sealing surface 67 coming into contact with the sealing wall surface 416 if the second chamber 42 is at a negative pressure below the predetermined threshold value. In this way, the inflow of the ink from the first chamber 41 to the second chamber 42 is prohibited. On the other hand, if the second chamber 42 is at a negative pressure exceeding the predetermined threshold value, the umbrella valve 66 moves leftward together with the valve holder 61 link-connected to the pressing member 5 and the sealing surface 67 is separated from the sealing wall surface 416 to open the communication opening 43 (release of sealing). In this way, the inflow of the ink from the first chamber 41 into the second chamber 42 is allowed.

In addition, the umbrella valve 66 singly opens the communication opening 43 if the pressure relationship of the second chamber 42 and the first chamber 41 is reversed, such as due to the application of the pressure of the pressurized ink to the second chamber 42 in the pressurized purge mode. That is, the umbrella valve 66 releases the sealed state of the communication opening 43 to release the pressure in the second chamber 42 to the first chamber 41 without being pressed by the pressing member 5. Specifically, the umbrella shape of the umbrella portion 661 (sealing surface 67) of the umbrella valve 66 is inverted when a predetermined pressure applied to the right surface side of the umbrella portion 661.

Figure 26B:
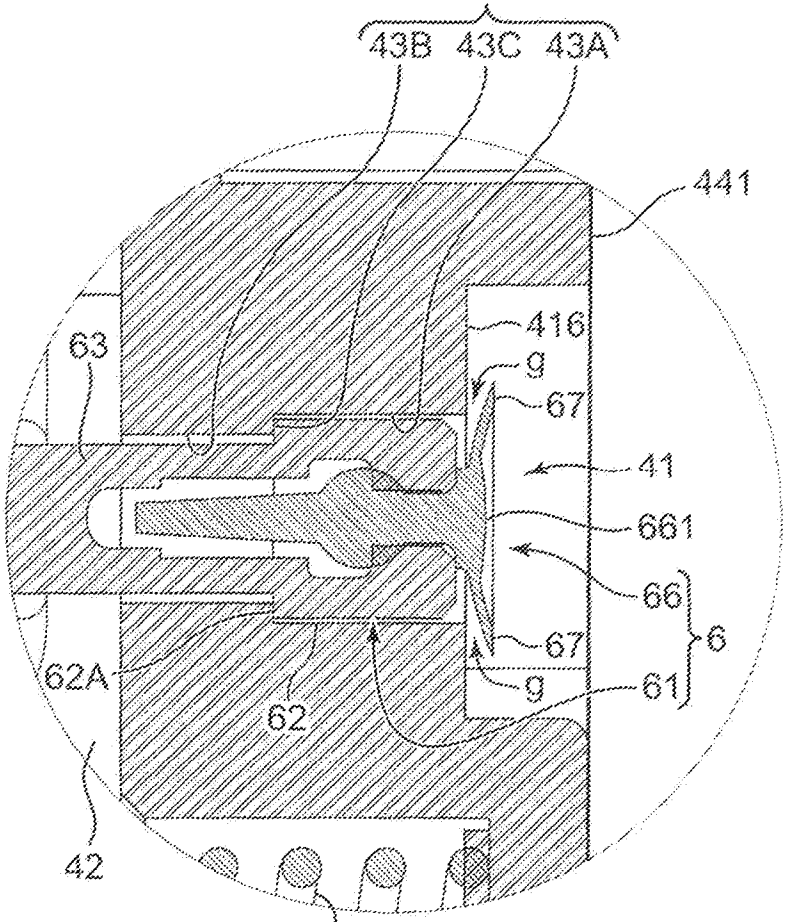
FIG. 26A is a sectional view showing a state where an umbrella valve is sealing a communication opening and FIG. 26B is a sectional view showing a state where the umbrella valve is opening the communication opening.
Figure 26A:
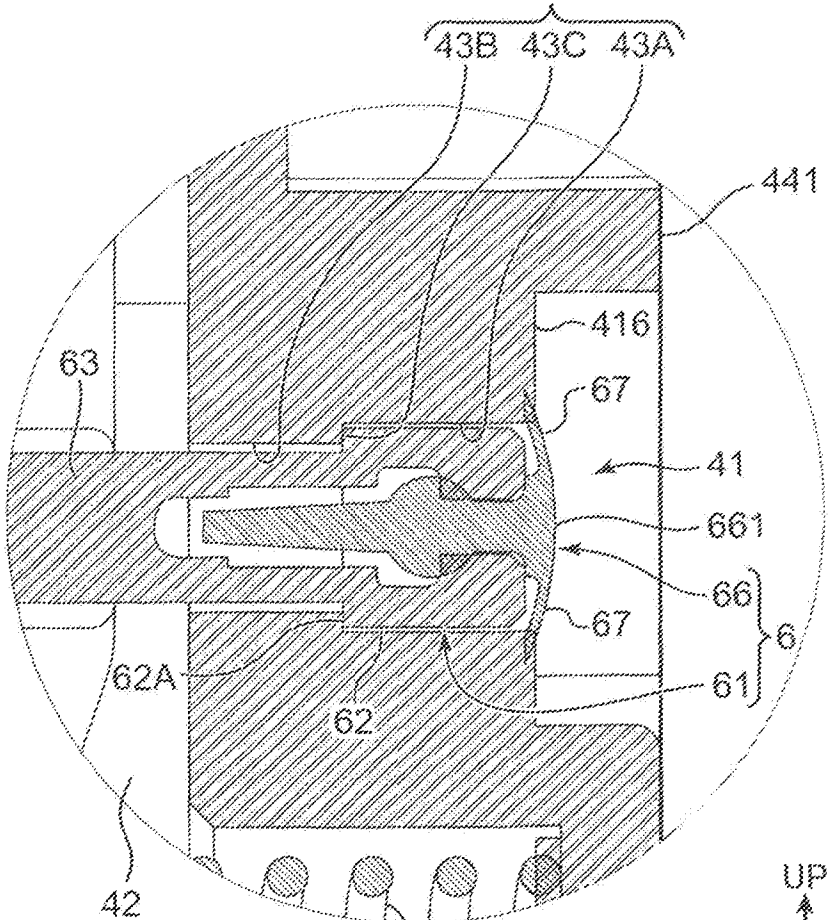
Figure 26A:
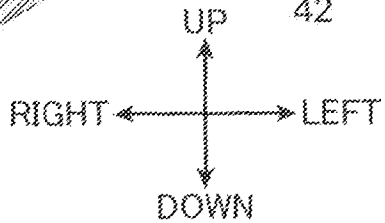

FIGS. 26A and 26B are sectional views respectively showing a state where the umbrella valve 66 seals the communication opening 43 and a state where the umbrella valve 66 opens the communication opening 43. The state of FIG. 26A is equal to the state of FIG. 14B previously described. The umbrella portion 661 has the umbrella shape convex leftward. Further, the valve holder 61 is located at a rightmost position by the biasing force of the biasing spring 45 and the annular contact portion 62A thereof is stopped in contact with the step portion 43C of the communication opening 43. Thus, the sealing surface 67 is in contact with the sealing wall surface 416.

The state of FIG. 26B is a state where the umbrella shape of the umbrella portion 661 of the umbrella valve 66 is inverted by the pressure applied from the side of the second chamber 42. That is, the umbrella portion 661 is deformed into an umbrella shape convex rightward. This inverted state is obtained when the pressure in the second chamber 42 becomes higher than that in the first chamber 41 by a predetermined value. In this embodiment, a case is assumed where a high positive pressure by pressurized purge is applied to the second chamber 42 and, as a result, the second chamber 42 is set to a higher pressure than in the first chamber 41 set at the atmospheric pressure+ρgh. The predetermined value depends on an inverted pressure of the umbrella portion 661. This inverted pressure is set at a value lower than the burst strength of the atmospheric pressure detection film 7 or the attachment strength of the atmospheric pressure detection film 7 to the second partition wall 421.

If the second chamber 42 is pressurized, the pressing member 5 does not rotate leftward. That is, the pressing member 5 generates no pressing force for pressing the on-off valve 6 leftward. This is because the atmospheric pressure detection film 7 is displaced to bulge rightward by a pressure increase of the second chamber 42 and applies no displacement force to the pressure receiving portion 5A. Thus, the valve holder 61 is maintained at the rightmost position by the biasing force of the biasing spring 45.

However, even if the valve holder 61 does not move, the sealing surface 67 is separated from the sealing wall surface 416 to create the gap g between the both by the inversion of the umbrella shape of the umbrella portion 661. Accordingly, the communication opening 43 is opened. In this way, the pressurized ink (pressure) in the second chamber 42 is allowed to escape (release) toward the first chamber 41 through the communication opening 43. Thus, it can be made possible to prevent an excessive force from acting on the atmospheric pressure detection film 7 itself or the attaching part thereof and prevent breakage.

[Modification]

Although the embodiment of the present disclosure has been described above, the present disclosure is not limited to this. For example, the following modifications can be employed.

(1) In the above embodiment, the pressing member 5 presses the on-off valve 6, utilizing the principle of leverage, with the pivot portions 53 serving as the fulcrum P1, the pressure receiving portion 5A serving as the point of force application P2 and the link bosses 54 serving as the point of action P3 (FIGS. 18A and 18B). In the present disclosure, the set positions of the pressure receiving portion 5A and the link bosses 54 are not limited as long as the pressing member 5 is rotatable about the pivot portions 53. The positions of the pressure receiving portion 5A and the link bosses 54 can be set according to a pressing force necessary to move the on-off valve 6. For example, the link bosses 54 may be arranged at the same position as the pressure receiving portion 5A on the back surface (second surface 51B) of the disk portion 51.

(2) Although the pressing member 5 and the on-off valve 6 are link-connected by the link bosses 54 and the link pins 65 in the above embodiment, the both may not be link-connected. For example, a state may be formed in which a part of the pressing member 5 and a part of the on-off valve 6 are constantly held in contact by a spring or the like and the pressing member 5 may press the on-off valve 6 through the contact parts.

(3) In the above embodiment, the pressing member 5 includes the pair of pivot portions 53 spaced apart in the direction of the axis of rotation. Instead of this, one long shaft extending in the direction of the axis of rotation may be used as the pivot portions 53. Alternatively, if the rotational twist of the pressing member 5 is not problematic, one arm having pivot portions formed on tips may be used in place of the pair of arm portions 52 and the pair of pivot portions 53 of the above embodiment. Further, the arm portions 52 may be omitted and the pivot portions 53 may be provided near the upper end of the disk portion 51.

(4) In the above embodiment, the structure in which the pressing member 5 rotates about the pivot portions 53 is illustrated. In another aspect of the present disclosure, the pressing member 5 may not include the pivot portions 53 as long as the pressing member 5 and the on-off valve 6 are link-connected. For example, a structure in which the pressing member 5 is attached to the atmospheric pressure detection film 7 may be adopted.

Figure 27B:
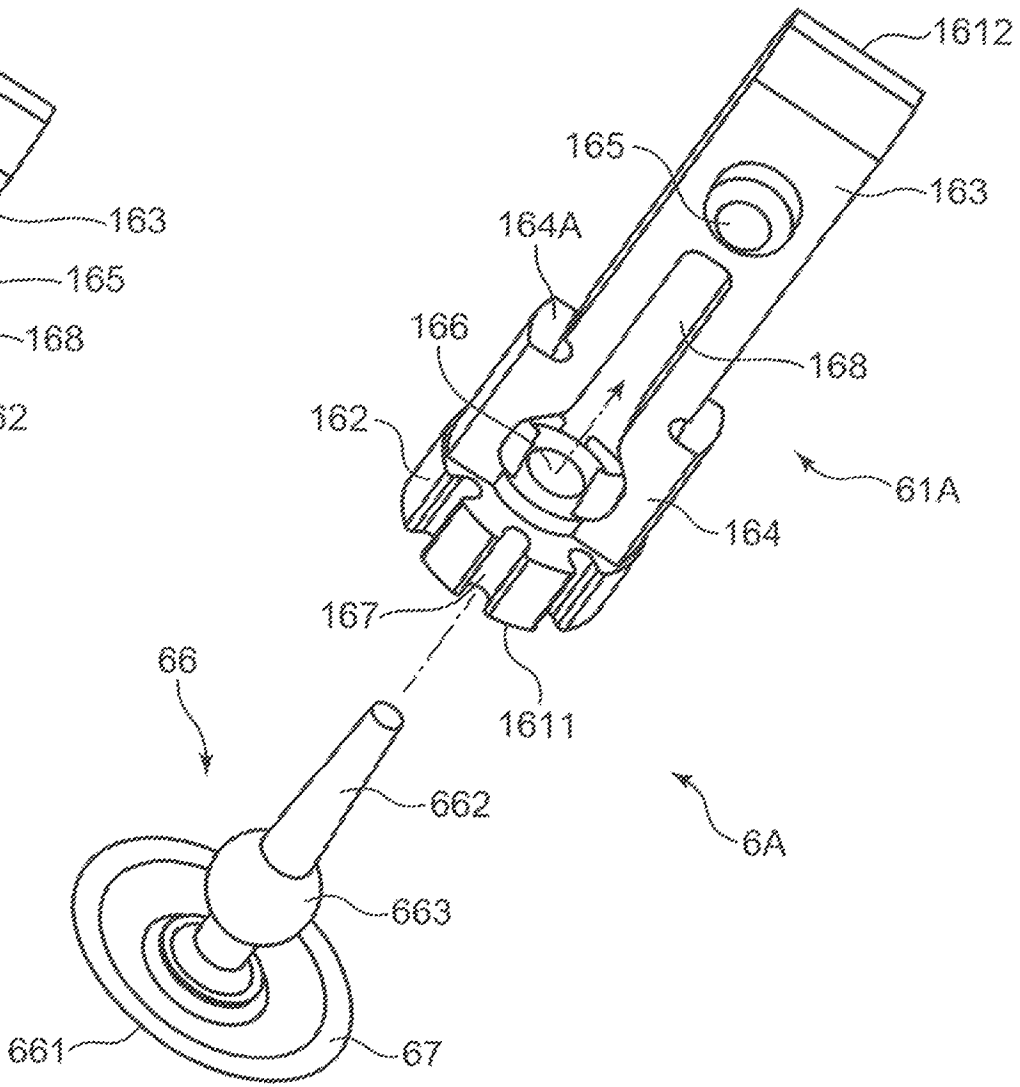
FIG. 27A is a perspective view of an on-off valve according to a modification and FIG. 27B is an exploded perspective view of the on-off valve.
Figure 27A:
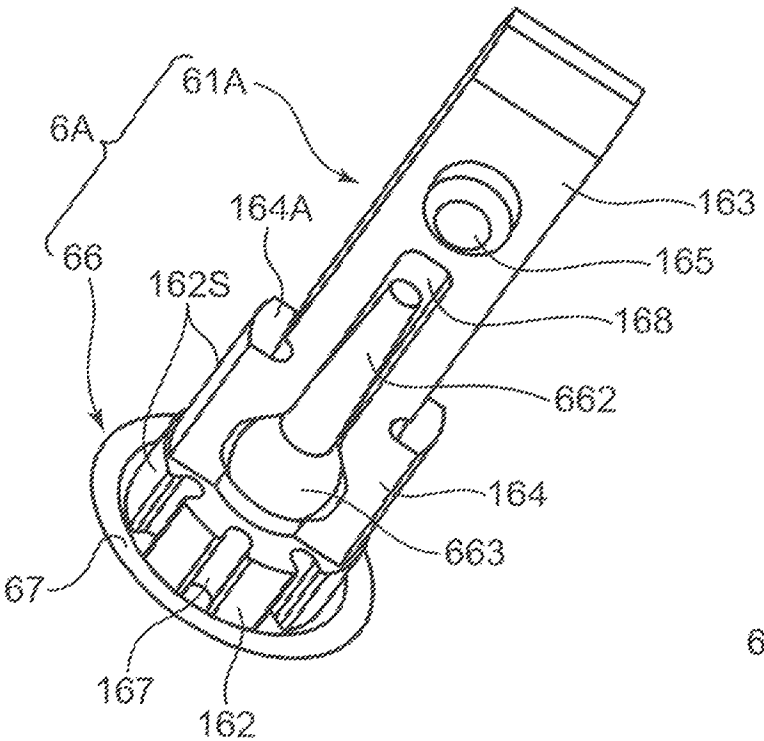

(5) Although the on-off valve 6 shown in FIGS. 13A and 13B is illustrated as an opening/closing member in the above embodiment, the opening/closing member may be changed to a valve of another form. FIG. 27A is a perspective view of an on-off valve 6A according to a modification and FIG. 27B is an exploded perspective view of the on-off valve 6A. The on-off valve 6A is an assembly of a valve holder 61A and an umbrella valve 66 held by this valve holder 61A. The umbrella valve 66 is not described here since having the same structure as the one previously described on the basis of FIG. 13B.

In a state mounted in the communication opening 43, the valve holder 61A includes a first end part 1611 located on the side of the first chamber 41 and a second end part 1612 located on the side of the second chamber 42. The valve holder 61A includes a tube portion 162 on the side of the first end part 1611, a flat plate portion 163 on the side of the second end part 1612, an intermediate portion 164 located between the tube portion 162 and the flat plate portion 163 and link pins 165 disposed on the flat plate portion 163. The umbrella valve 66 is held on the side of the first end part 1611 of the valve holder 61A.

The tube portion 162 is a hollow cylindrical part including a through hole 166, through which a pin portion 662 of the umbrella valve 66 is inserted, in a radial center. An inner diameter of the through hole 166 is smaller than a locking spherical portion 663 of the umbrella valve 66, but the pin portion 662 is inserted into the through hole 166 from the side of the first end part 1611 in such a manner that the locking spherical portion 663 is pressed to pass through the through hole 166 utilizing rubber elasticity. A plurality of radially recessed flow passage grooves 167 are provided at equal intervals in a circumferential direction on the outer peripheral surface of the tube portion 162. The flow passage grooves 167 serve as flow passages in which the ink flows when the on-off valve 6A is in an opening posture.

The intermediate portion 164 is a flat plate part having a width substantially equal to an outer diameter of the tube portion 162 and wider than the flat plate portion 163. A pin housing portion 168 formed by a cutout for housing the pin portion 662 is provided from the intermediate portion 164 to the flat plate portion 163. The tube portion 162 and the intermediate portion 164 are housed into the large-diameter portion 43A of the communication opening 43. The outer peripheral surfaces of the tube portion 162 and the intermediate portion 164 serve as guide surfaces 162S to be guided by the large-diameter portion 43A when the on-off valve 6A moves in the lateral direction. A contact portion 164A formed by a step based on a width difference of the flat plate portion 163 and the intermediate portion 164 is present on a boundary part between the flat plate portion 163 and the intermediate portion 164. The contact portion 164A faces and comes into contact with the step portion 43C (FIG. 14) of the communication opening 43. The link pins 165 projecting on the flat plate portion 163 are fit into the link holes 541 (FIG. 12B) provided in the link bosses 54 of the pressing member 54.

Also in this on-off valve 6A, a sealing surface 67 of the umbrella valve 66 comes into contact with the sealing wall surface 426 in the closing posture (FIG. 14B), whereby the communication opening 43 is sealed. On the other hand, in the opening posture, the sealing surface 67 is separated from the sealing wall surface 416 and the ink flows through the flow passage grooves 167. Further, the umbrella shape of an umbrella portion 661 is inverted when an excessive inner pressure acts in the second chamber 42 as described with reference to FIGS. 26A and 26B. The on-off valve 6A as described above also can function as the opening/closing member.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A liquid supply unit for injecting predetermined liquid from a liquid storage container storing the liquid to a liquid injection head for injecting the liquid, comprising:

a first chamber communicating with the liquid storage container;

a second chamber arranged downstream of the first chamber in a liquid supply direction and communicating with the liquid injection head;

a wall portion including a communication opening allowing communication between the first chamber and the second chamber;

an opening/closing member arranged in the communication opening, a posture of the opening/closing member being changed between a closing posture for closing the communication opening and an opening posture for opening the communication opening;

a biasing member configured to bias the opening/closing member in a direction toward the closing posture;

a pressing member capable of pressing the opening/closing member in a direction toward the opening posture; and a flexible film member configured to be displaced based on a negative pressure generated as the liquid in the second chamber decreases and transmit a displacement force thereof to the pressing member;

wherein the pressing member:

includes a pivot point, a pressure receiving portion configured to receive the displacement force from the flexible film member and a pressing portion configured to press the opening/closing member against a biasing force of the biasing member, and a flat plate portion having the pivot point arranged on one end side, the flat plate being rotatable about the pivot point;

the pressure receiving portion is set at a predetermined position of the flat plate portion; and the pressing portion is set between the pressure receiving portion and the pivot point on the flat plate portion; and the pressing member rotates about the pivot point when the pressure receiving portion receives the displacement force, the pressing portion pressing the opening/closing member by the rotation of the pressing member.

2. The liquid supply unit of claim 1, wherein:

the opening/closing member is link-connected to the pressing member at the pressing portion.

3. The liquid supply unit of claim 1, wherein:

one end and the other end on an axis of rotation of the pivot point are separated from each other across a central area of the flat plate portion in a plane direction.

4. The liquid supply unit of claim 1, wherein:

the pressing member includes an arm portion extending outward from the one end side of the flat plate portion; and the pivot point is provided on an extending tip part of the arm portion.

5. The liquid supply unit of claim 1, wherein:

the opening/closing member is link-connected to the flat plate portion at the pressing portion; and the biasing member biases the opening/closing member in the direction toward the closing posture by biasing the flat plate portion.

6. The liquid supply unit of claim 5, wherein:

the opening/closing member includes:

a valve holder having a guide surface to be guided by an inner surface of the communication opening, a flow passage for the liquid, a first end part on the first chamber side and a second end part on the second chamber side, the valve holder being inserted into the communication opening;

a valve member held in the first end part of the valve holder and configured to seal the communication opening in the closing posture while releasing the sealing of the communication opening in the opening posture; and a first link engaging portion disposed in the second end part of the valve holder for the link connection, and the pressing member includes a second link engaging portion to be link-connected to the first link engaging portion at the pressing portion.

7. The liquid supply unit of claim 5, wherein:

the flat plate portion has a first surface facing the flexible film member and a second surface facing the opening/closing member;

the pressure receiving portion is set at a predetermined position of the first surface; and a biased portion configured to receive the biasing force from the biasing member is set at a position corresponding to the pressure receiving portion on the second surface.

8. The liquid supply unit of claim 1, wherein:

the liquid storage container is arranged above the liquid injection head;

the liquid supply unit is arranged between the liquid storage container and the liquid injection head and supplies the liquid to the liquid injection head by a water head difference;

the second chamber is set to a negative pressure when the liquid is normally supplied; and the flexible film member generates a pressing force acting against the biasing force of the biasing member when the second chamber is set to a negative pressure exceeding a predetermined threshold value as the liquid in the second chamber decreases.

9. A liquid injection device, comprising:

a liquid injection head configured to inject predetermined liquid;

the liquid supply unit of claim 1 configured to supply the liquid from a liquid storage container storing the liquid to the liquid injection head;

a first supply passage allowing communication between the liquid storage container and the first chamber of the liquid supply unit; and a second supply passage allowing communication between the liquid injection head and the second chamber of the liquid supply unit.

* * * * *